US010901342B2

(12) United States Patent
Sako et al.

(10) Patent No.: US 10,901,342 B2
(45) Date of Patent: Jan. 26, 2021

(54) DEVELOPING DEVICE AND IMAGE FORMING APPARATUS

(71) Applicant: FUJI XEROX CO., LTD., Tokyo (JP)

(72) Inventors: Kiyoshi Sako, Kanagawa (JP); Eriko Kokubun, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/282,322

(22) Filed: Feb. 22, 2019

(65) Prior Publication Data

US 2020/0033759 A1 Jan. 30, 2020

(30) Foreign Application Priority Data

Jul. 27, 2018 (JP) ..... 2018-141240

(51) Int. Cl.
*G03G 15/08* (2006.01)

(52) U.S. Cl.
CPC ..... *G03G 15/0891* (2013.01); *G03G 15/0853* (2013.01); *G03G 15/0889* (2013.01); *G03G 2215/0827* (2013.01)

(58) Field of Classification Search
CPC ..... G03G 15/0891; G03G 15/0853; G03G 15/0889
See application file for complete search history.

(56) References Cited

U.S. PATENT DOCUMENTS 6,415,125 B1 * 7/2002 Yamamoto ..... G03G 15/0822 399/254
2017/0227886 A1 8/2017 Kato et al.

FOREIGN PATENT DOCUMENTS

| | | |
|---|---|---|
| JP | H10268623 | 10/1998 |
| JP | 2017116778 | 6/2017 |
| JP | 2017138505 | 8/2017 |

* cited by examiner

*Primary Examiner* — Walter L Lindasy, Jr.
*Assistant Examiner* — Andrew V Do
(74) *Attorney, Agent, or Firm* — JCIPRNET

(57) ABSTRACT

A developing device includes an agitating transport device, a density detecting device, and an attracting device. The agitating transport device has a transport path and transports developer including a magnetic carrier while agitating the developer. The density detecting device detects density of the developer in the transport path of the agitating transport device. The attracting device is provided in the agitating transport device and has magnetic poles of one and another polarities exposed to the transport path facing the density detecting device so as to attract the developer by a magnetic force.

9 Claims, 21 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2018-141240 filed Jul. 27, 2018.

BACKGROUND

(i) Technical Field

The present disclosure relates to a developing device and an image forming apparatus.

(ii) Related Art

Some related-art developing devices include a density detecting device that detects the density of developer transported by an agitating transport device. As techniques that improve accuracy in detecting the density of developer with the density detecting device for such developing devices, techniques disclosed in, for example, Japanese Unexamined Patent Application Publication Nos. 10-268623, 2017-116778, 2017-138505, and so forth have already been proposed.

According to Japanese Unexamined Patent Application Publication No. 10-268623, a developing device with a toner density magnetic sensor includes a toner density magnetic sensor, an agitating device, and a cleaning magnet. The toner density magnetic sensor detects the mixing ratio of developer including toner particles and magnetic particles. The agitating device agitates the developer on a detecting surface of the toner density magnetic sensor through rotation about the axis. The cleaning magnet rubs the detecting surface of the toner density magnetic sensor by utilizing a magnetic brush action while being rotated together with the agitating device. In this developing device, the mixing ratio is detected while suppressing output variation caused by a magnetized state of the toner density magnetic sensor due to the cleaning magnet.

According to Japanese Unexamined Patent Application Publication No. 2017-116778, in order to suppress variation of the magnetic permeability due to variation of the density of developer, the shapes of a first paddle and a second paddle of an agitating transport member are contrived. Here, the agitating transport member transports two-component developer including non-magnetic toner and a magnetic carrier while agitating the developer.

According to Japanese Unexamined Patent Application Publication No. 2017-138505, a retaining member is provided. The retaining member includes a non-acting portion. The non-acting portion suppresses acting of a force that radially outwardly transports developer on the developer, thereby causing the developer to be retained in a region corresponding to a detecting device of transport member.

SUMMARY

Aspects of non-limiting embodiments of the present disclosure relate to improvement of accuracy in detecting the density of developer compared to the case where a magnetic pole of only one of polarities of an attracting device that attracts developer by a magnetic force is exposed to a transport path facing a density detecting device.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a developing device including an agitating transport device, a density detecting device, and an attracting device. The agitating transport device has a transport path and transports developer including a magnetic carrier while agitating the developer. The density detecting device detects density of the developer in the transport path of the agitating transport device. The attracting device is provided in the agitating transport device and has magnetic poles of one and another polarities exposed to the transport path facing the density detecting device so as to attract the developer by a magnetic force.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure will be described below with reference to the drawings.

First Exemplary Embodiment

Figure 1:
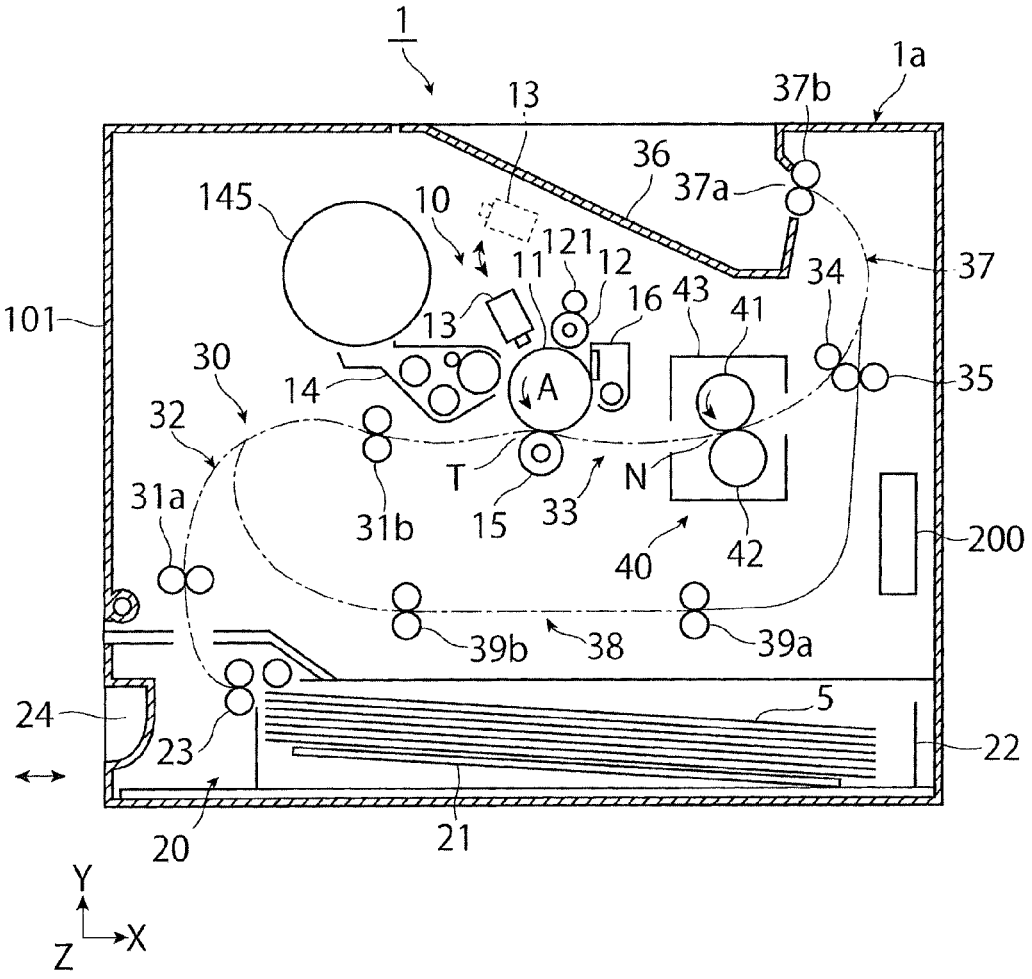
FIG. 1 is a schematic view of the structure of an image forming apparatus for which a developing device according to a first exemplary embodiment of the present disclosure is used.
Figure 2:
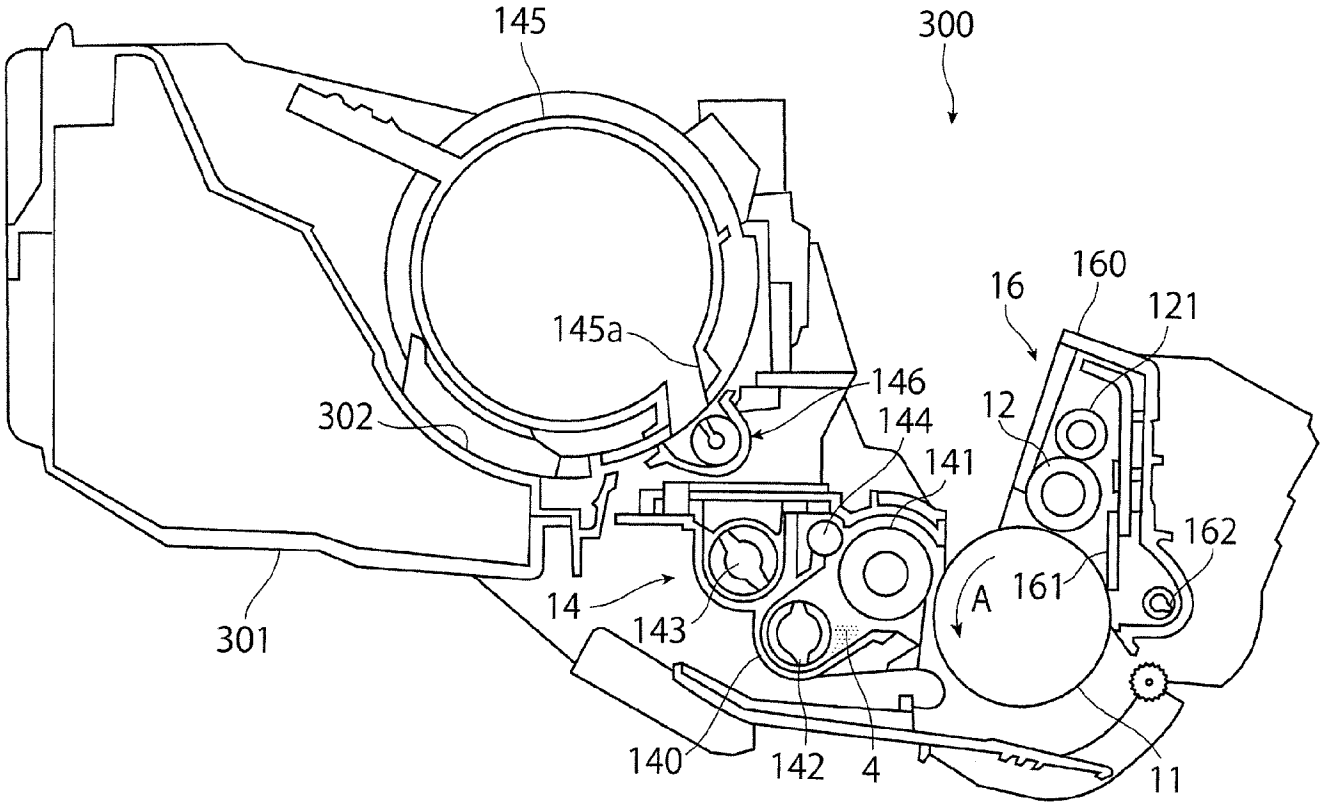
FIG. 2 illustrates the structural of a process cartridge of the image forming apparatus according to the first exemplary embodiment of the present disclosure.

FIGS. 1 and 2 illustrate an image forming apparatus for which a developing device according to a first exemplary embodiment is used. FIG. 1 schematically illustrates the entirety of the image forming apparatus. FIG. 2 is an enlarged view of part (image forming unit) of the image forming apparatus. In, for example, FIG. 1, an arrow X indicates a depth direction along the horizontal direction, an arrow Y indicates the vertical direction, and an arrow Z indicates a width direction along the horizontal direction.

Overall Structure of the Image Forming Apparatus

An image forming apparatus 1 according to a first exemplary embodiment is, for example, a monochrome printer. As illustrated in FIG. 1, the image forming apparatus 1 includes an image making device 10, a sheet feed device 20, a transport device 30, a fixing device 40, and so forth. The image making device 10 forms a toner image developed with toner included in developer. The sheet feed device 20 contains required recording sheets of paper 5 and supplies each of the recording sheets 5 to a transfer position of the image making device 10. The transport device 30 transports, along a transport path indicated by a one-dot chain line in, for example, FIG. 1, the recording sheet 5 having been supplied from the sheet feed device 20. The fixing device 40 fixes the toner image on of the recording sheet 5 having been transferred onto the recording sheet 5 by the image making device 10.

The image making device 10 includes a photoconductor drum 11 that serves as an example of an image holding device and is rotated. The following devices serving as examples of elements of an image forming device are typically disposed around the photoconductor drum 11. These devices include a charger 12, a light exposure device 13, a developing device 14, a transfer device 15, a drum cleaner 16, and so forth. The charger 12 charges to a required potential a circumferential surface (image holding surface) of the photoconductor drum 11 that allows the image to be formed thereon. The light exposure device 13 radiates light in accordance with image information (signal) to the charged circumferential surface of the photoconductor drum 11 so as to form an electrostatic latent image having potential variations. The developing device 14 develops the electrostatic latent image into the toner image with the toner of black developer. The transfer device 15 transfers the toner image onto the recording sheet 5. The drum cleaner 16 cleans the image holding surface of the photoconductor drum 11 having undergone transfer by removing matter such as toner remaining on and attracted to the image holding surface.

The photoconductor drum 11 has the image holding surface having a photoconductive layer (photosensitive layer) formed of a photosensitive material. The photoconductive layer is formed on a circumferential surface of a grounded base material having a cylindrical or columnar shape. The photoconductor drum 11 is supported so as to be rotatable in an arrow A direction by transmitting drive power from a drive device (not illustrated).

The charger 12 includes a contact-type charging roller disposed so as to be in contact with the photoconductor drum 11. A charging voltage is supplied to the charger 12. When the developing device 14 performs reversal development, a voltage or a current of the same polarity as the polarity to which the toner supplied from the developing device 14 is charged is supplied as the charging voltage. A cleaning roller 121 that cleans the surface of the charger 12 is disposed behind the charger 12 so as to be in contact with the charger 12. As the charger 12, a contactless-type charger such as a scorotron disposed so as not to be in contact with the surface of the photoconductor drum 11 may be used.

The light exposure device 13 includes a light emitting diode (LED) print head. The LED print head uses a plurality of LEDs as light emitting elements arranged in the axial direction of the photoconductor drum 11 so as to radiate light in accordance with the image information toward the photoconductor drum 11 to form the electrostatic latent image. Alternatively, the light exposure device 13 may use laser light formed in accordance with the image information to perform deflection scanning in the axial direction of the photoconductor drum 11.

As illustrated in FIG. 2, the developing device 14 includes, for example, a developing roller 141, an agitating supply member 142 and an agitating transport member 143, and a layer-thickness regulating member 144. These elements are disposed in a device housing 140 that has an opening and container chamber for developer 4. The developing roller 141 holds the developer 4 and transports the developer 4 to a developing region facing the photoconductor drum 11. The agitating supply member 142 and the agitating transport member 143 that each are a screw auger or the like and transport the developer 4 while agitating the developer 4 so that the developer 4 passes through the developing roller 141. The layer-thickness regulating member 144 regulates the amount (layer thickness) of the developer 4 held by the developing roller 141. A developing bias voltage is supplied between the developing roller 141 and the photoconductor drum 11 of the developing device 14 from a power unit (not illustrated). For example, a two-component developer that includes non-magnetic toner and a magnetic carrier is used as the developer 4. The details of the structure of the developing device 14 will be described later.

As illustrated in FIG. 1, the transfer device 15 is a contact-type transfer device that includes a transfer roller. During image formation, the transfer roller is in contact with a circumference of the photoconductor drum 11, through the recording sheet 5, so as to be rotated, and supplied with a transfer voltage. As the transfer voltage, a direct-current voltage the polarity of which is opposite to the polarity to which the toner is charged is supplied from a power unit (not illustrated).

As illustrated in FIG. 2, the drum cleaner 16 includes, for example, a body 160, a cleaning plate 161, and a feed member 162. The body 160 has a container shape and is partially opened. The cleaning plate 161 is disposed so as to be in contact at a required pressure with the circumferential surface of the photoconductor drum 11 having undergone first transfer, thereby cleaning the circumferential surface of the photoconductor drum 11 by removing attracted matter such as residual toner. The feed member 162 that includes a screw auger or the like collects the attracted matter such as toner removed by the cleaning plate 161 and transports the attracted matter so as to feed the attracted matter to a collection system (not illustrated). A plate-shaped member (for example, blade) formed of a material such as rubber is used as the cleaning plate 161.

As illustrated in FIG. 1, the fixing device 40 includes, for example, a heating rotating body 41 and a pressure rotating body 42 which are disposed in a housing 43 having an introduction opening and an exit opening for the recording sheet 5. The heating rotating body 41 is in the form of a roller or a belt, rotated in a direction indicated by an arrow, and heated by a heating device so that the surface temperature of the heating rotating body 41 is maintained at a specified temperature. The pressure rotating body 42 is in the form of a belt or a roller and in contact with the heating rotating body 41 substantially in the axial direction of the heating rotating body 41 at a specified pressure, thereby the pressure rotating body 42 is rotated. This fixing device 40 has a contact portion where the heating rotating body 41 and the pressure rotating body 42 are in contact with each other. This contact portion serves as a fixing process portion (nip) N where the required fixing process (heating and applying pressure) is performed.

The sheet feed device 20 is disposed below the image making device 10 in the vertical direction Y. This sheet feed device 20 includes, for example, plural (or a single) sheet containers 22 and plural (or a single) feed devices 23. The sheet containers 22 each contain the recording sheets 5 of a size, type, and so forth a user wishes to use. The recording sheets 5 are placed on a placement plate 21. The feed devices 23 each feed one sheet after another from the recording sheets 5 contained in a corresponding one of the sheet containers 22. The sheet feed device 20 is detachable from an apparatus body 1*a* of the image forming apparatus 1 by holding and drawing a handle 24 provided on a front surface of the sheet container 22.

Examples of the recording sheets 5 include, for example, plain paper used for electrophotographic copiers, printers, and so forth, thin paper such as tracing paper, and overhead projector (OHP) transparencies. In order to further improve smoothness of image surfaces after fixing, smoothness of the front side of the recording sheets 5 may be increased as much as possible. For example, coated paper made by coating the front side of plain paper with resin or the like, so-called cardboard such as art paper for printing having a comparatively large basis weight, and the like may also be used.

As illustrated in FIG. 1, a sheet feed transport path 32 is provided between the sheet feed device 20 and the transfer device 15 such that the sheet feed transport path 32 extends upward in the vertical direction Y along a front surface of the apparatus body 1*a* and is curved midway to extend next in the horizontal direction X toward the inside of the apparatus body 1*a*. The sheet feed transport path 32 is formed by a single or a plurality of sheet transport roller pairs 31*a* and a single or a plurality of sheet transport roller pairs 31*b* and, in addition, a transport guide (not illustrated). The sheet transport roller pairs 31*a*, 31*b* transport each of the recording sheets 5 fed from the sheet feed device 20 to a transfer position T. The sheet transport roller pair 31*b* disposed at a position immediately upstream of the second transfer position T in a direction in which the recording sheet 5 is transported in the sheet feed transport path 32, serves as, for example, rollers that adjust timing at which the recording sheet 5 is transported (registration rollers). Furthermore, a sheet transport path 33 is provided in a region from the transfer device 15 to the fixing device 40 so as to extend in the horizontal direction X. The recording sheet 5 having undergone the transfer and fed from the transfer device 15 is transported to the fixing device 40 through the sheet transport path 33.

Furthermore, an output transport path 37 is provided obliquely above the fixing device 40. The recording sheet 5 is transported and output to a sheet output section 36 through the output transport path 37 by using a transport roller pair 34 out of two transport roller pairs 34, 35, which share a single common transport roller. The sheet output section 36 is provided in an inclined state on an upper end surface of the apparatus body 1*a*.

An output roller pair 37*b* used to output and invert the recording sheet 5 is provided at an exit 37*a* of the output transport path 37. The rotating directions of the output roller pair 37*b* are switchable between the normal and the reverse directions.

Furthermore, a switching gate (not illustrated) used to switch the transport direction of the recording sheet 5 is provided upstream of the output roller pair 37*b* in a direction in which the recording sheet 5 is output. When duplex printing is performed on the recording sheet 5, the transport direction of the recording sheet 5 is switched by the switching gate (not illustrated) from the output transport path 37 to a duplex transport path 38. At this time, after the trailing end of the recording sheet 5 being transported in the output direction has passed through the switching gate (not illustrated), the rotating directions of the output roller pair 37*b* are switched from the normal directions (output directions) to the reverse directions. A transport path of the recording sheet 5 transported in the reverse direction by the output roller pair 37*b* is switched by the switching gate (not illustrated) so as to be transported downward in the vertical direction Y. This recording sheet 5 is transported, through the other transport roller pair 35, to the duplex transport path 38 that extends in the vertical direction Y along a rear surface of the apparatus body 1*a* of the image forming apparatus 1 and is curved so as to extend next in the horizontal direction X. The duplex transport path 38 is provided with, for example, a transport guide (not illustrated) and sheet transport roller pairs 39*a*, 39*b* that transport the inverted recording sheet 5 to the sheet transport roller pair 31*b*.

As illustrated in FIG. 1, a toner cartridge 145 is disposed above a rear surface of the developing device 14. The toner cartridge 145 serving as an example of a developer container device contains therein the developer 4 at least including the toner to be supplied to the developing device 14. A toner supply device 146 that supplies the toner to the developing device 14 through a toner supply opening 145*a* of the toner cartridge 145 is, as illustrated in FIG. 2, provided below the toner cartridge 145.

Furthermore, reference numeral 200 of FIG. 1 denotes a controller that controls operation of the image forming apparatus 1 in a centralized manner. The controller 200 includes elements (not illustrated) such as a central processing unit (CPU), a read only memory (ROM), a random access memory (RAM), buses through which these CPU, ROM, and so forth are connected, and a communication interface.

Process Cartridge

According to the present exemplary embodiment, as illustrated in FIG. 2, the elements of the image making device 10 other than the light exposure device 13 and the transfer device 15 are included in a process cartridge 300 serving as an example of an image forming unit detachably attached to the apparatus body 1*a* of the image forming apparatus 1. The process cartridge 300 includes a cartridge body 301 in which the photoconductor drum 11, the charger 12, the developing device 14, the toner cartridge 145, and the drum cleaner 16 are integrally mounted. The cartridge body 301 has, at one side thereof, a recessed accommodating portion 302 that accommodates the toner cartridge 145 such that the toner cartridge 145 alone is detachably attached.

As illustrated in FIG. 1, the light exposure device 13 is movable to a retracted position indicated by a dotted line. This movement of the light exposure device 13 is coupled with opening/closing operation of a front covering 101 performed when the process cartridge 300 is attached to or detached from the apparatus body 1*a*.

Basic Operation of the Image Forming Apparatus

Basic image forming operation performed by the image forming apparatus 1 is described below.

Upon reception of instruction information requesting a monochrome image forming operation (printing) from an operating panel (not illustrated) mounted on the apparatus body 1*a*, a user interface (not illustrated), a printer driver (not illustrated), or the like, the image forming apparatus 1, which is controlled by the controller 200, starts the image making device 10, the sheet feed device 20, the transport device 30, the fixing device 40, and so forth.

Consequently, in the image making device 10, as illustrated in FIG. 1, first, the photoconductor drum 11 is rotated in the arrow A direction, and the charger 12 charges the surface of the photoconductor drum 11 to a required polarity (negative polarity according to the first exemplary embodiment) and a required potential. Next, the light exposure device 13 radiates the light emitted in accordance with the image information input to the image forming apparatus 1 to the charged surfaces of the photoconductor drum 11. Thus, the electrostatic latent image having the required potential difference is formed on the surface of the photoconductor drum 11.

Next, the developing device 14 supplies black toner charged to the required polarity (negative polarity) from the developing roller 141 to the electrostatic latent image formed on the photoconductor drum 11. Thus, the electrostatic latent image is developed by causing the toner to be electrostatically attracted to the photoconductor drum 11. Through this development, the electrostatic latent image formed on the photoconductor drum 11 becomes a visual toner image developed with the black toner. The toner is supplied at required timing from the toner cartridge 145 to the developing device 14 of the process cartridge 300 through the toner supply device 146.

Next, when the toner image formed on the photoconductor drum 11 is transported to the transfer position T, the transfer device 15 transfers the toner image onto the recording sheet 5.

The drum cleaner 16 cleans the surface of the photoconductor drum 11 by removing the attracted matter such that the attracted matter is scraped off from the surface of the photoconductor drum 11 in the image making device 10 where the transfer has been performed. Thus, the image making device 10 is ready to perform the next image making operation.

Meanwhile, the sheet feed device 20 feeds the required recording sheet 5 to the sheet feed transport path 32 in accordance with the image making operation. The recording sheet 5 is fed and supplied to the transfer position T by the sheet transport roller pair 31*b* serving as the registration rollers at timing adjusted to timing of the transfer in the sheet feed transport path 32.

Next, the recording sheet 5 onto which the toner image has been transferred is transported to the fixing device 40 through the sheet transport path 33. The recording sheet 5 having undergone the transfer is introduced into and passes through the fixing processing portion N between the heating rotating body 41 being rotated and the pressure rotating body 42 being rotated so as to be subjected to the required fixing process (heating and applying pressure) in the fixing device 40. Thus, the unfixed toner image is fixed onto the recording sheet 5. In the case of an image forming operation where image formation is performed on only one of the sides of the recording sheet 5, the recording sheet 5 having undergone the fixing is output along the output transport path 37 by the output roller pair 37*b* to the sheet output section 36 provided in an upper end portion of the apparatus body 1*a*.

In order to form images on both sides of the recording sheet 5, the recording sheet 5 on one side of which an image has been formed is transported to the output roller pair 37*b* by using the switching gate. Thus, the recording sheet 5 is once transported in the output direction by the output roller pair 37*b*. Then, the rotating directions of the output roller pair 37*b* are reversed while the trailing end of the recording sheet 5 remains pinched by the output roller pair 37*b*, thereby the recording sheet 5 is inverted. Then, the recording sheet 5 is transported again to the transfer device 15 through the duplex transport path 38 by using the switching gate (not illustrated) so as to transfer a toner image on the back side of the recording sheet 5. The recording sheet 5 onto the back side of which the toner image has been transferred is transported to the fixing device 40 through the sheet transport path 33, subjected to the fixing process (heating and applying pressure) by the fixing device 40, and output by the output roller pair 37*b* to the sheet output section 36.

Through the above-described operation, the recording sheet 5 on one side or both the front and back sides of which the monochrome image or the monochrome images have been formed is output.

Structure of the Developing Device

Figure 3:
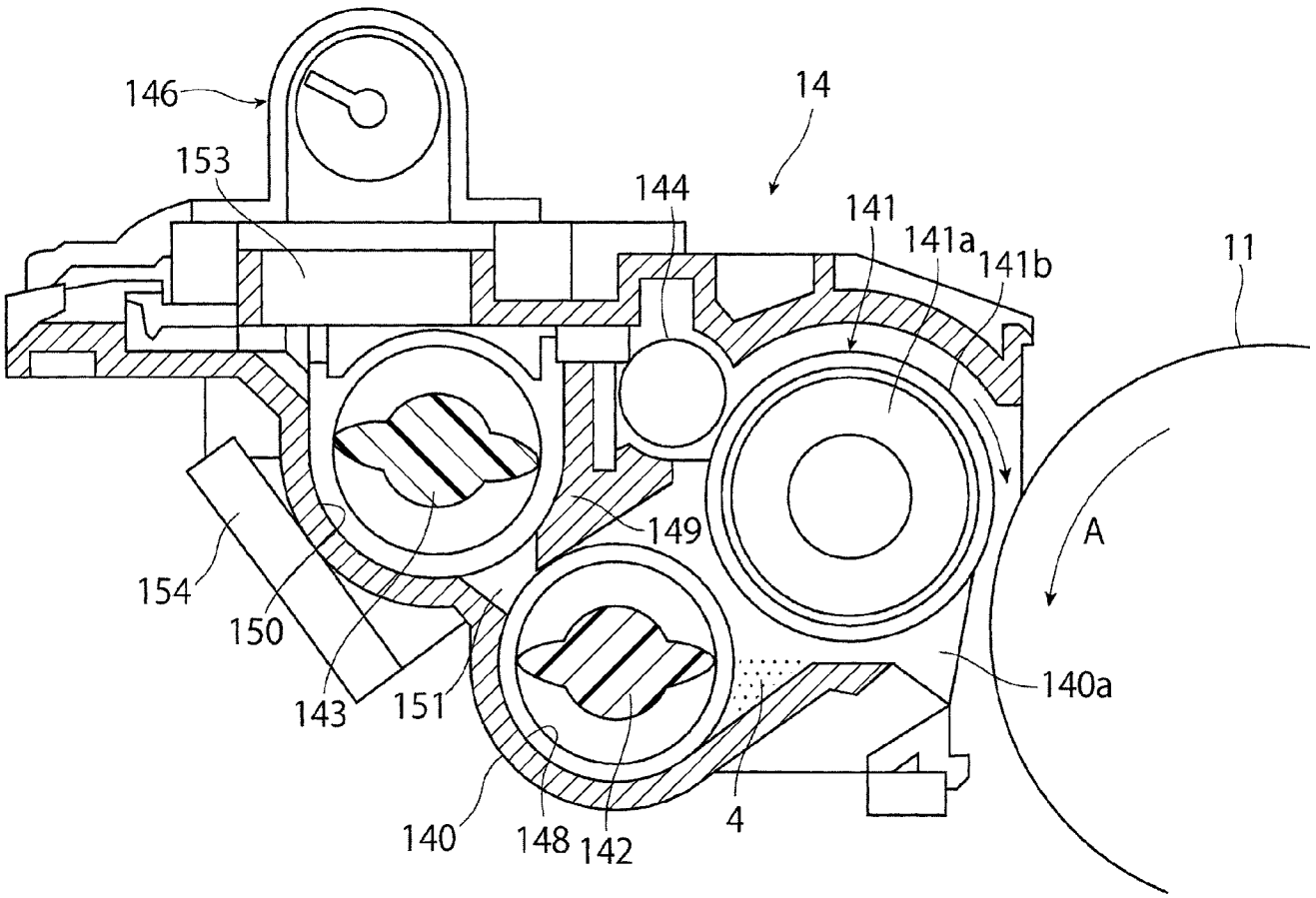
FIG. 3 is a sectional view of the structure of the developing device according to the first exemplary embodiment of the present disclosure.

A so-called two-component developing method is employed for the developing device 14 according to the first exemplary embodiment. As illustrated in FIG. 3, the developing device 14 includes the device housing 140 serving as an example of a developing device body. The device housing 140 has an opening 140*a* in a region facing the photoconductor drum 11. The developing roller 141 serving as an example of a developer holding device is disposed in the opening 140*a* of the device housing 140. The developing roller 141 includes a magnet roller 141*a* and a developing sleeve 141*b*. The magnet roller 141*a* having a columnar shape or a cylindrical shape is fixed in the developing roller 141. The magnet roller 141*a* is magnetized such that magnetic poles of required polarities are provided at required positions in the circumferential direction. The developing sleeve 141*b* having a cylindrical shape is rotatably disposed on the outer circumference of the magnet roller 141*a*. The developing sleeve 141*b* transports the developer 4 attracted by magnetic force of the magnet roller 141*a* along the circumferential direction so as to cause the developer 4 to pass through a developing region facing the photoconductor drum 11.

Figure 4:
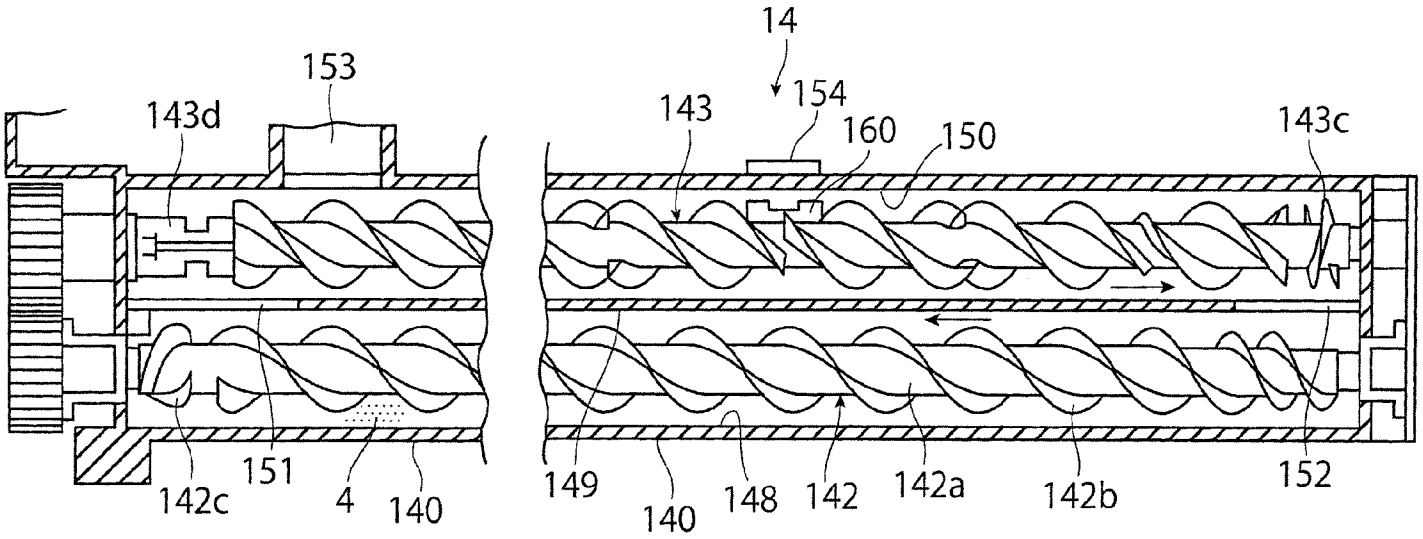
FIG. 4 is a sectional view of the structure of the developing device according to the first exemplary embodiment of the present disclosure.

As illustrated in FIGS. 3 and 4, the device housing 140 has a first developer containing portion 148 and a second developer containing portion 150. The first developer containing portion 148 contains the developer 4 and is disposed at a position obliquely below and adjacent to the developing roller 141. The second developer containing portion 150 is disposed at a position obliquely above in the direction of gravity and adjacent to the first developer containing portion 148 with an obliquely inclined separator wall 149 interposed therebetween. Lower halves of the first and second developer containing portions 148, 150 have respective cylindrical sectional shapes. The second developer containing portion 150 communicates with the first developer containing portion 148 through communication openings 151, 152 thereof at both ends in the axial direction.

Figure 5:
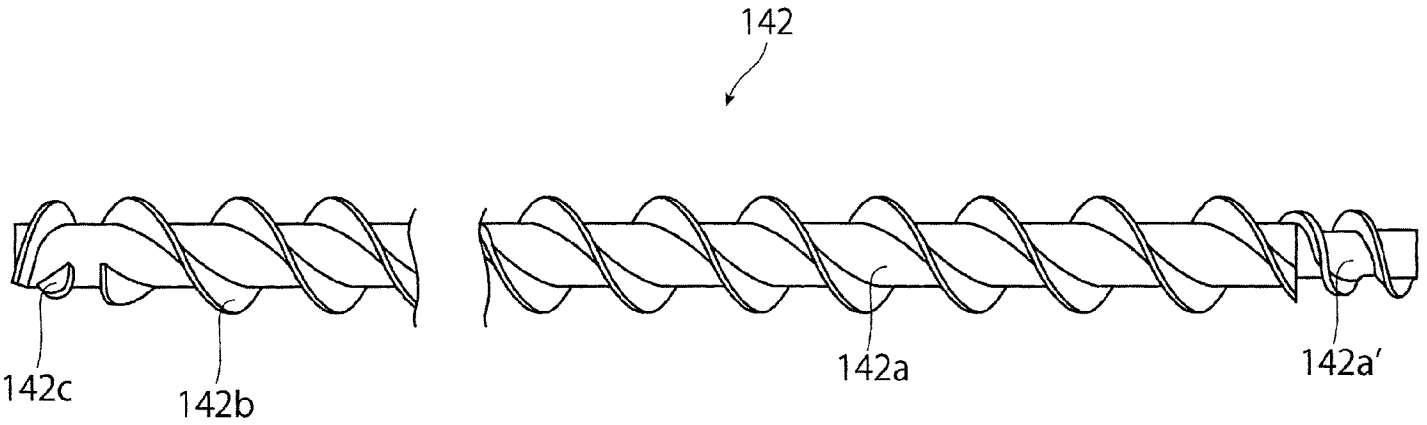
FIG. 5 is a front view of the structure of an agitating supply member.

The first and second developer containing portions 148, 150 each contain the two-component developer 4. As illustrated in FIG. 4, the helical agitating supply member 142 serving as an example of a first developer agitating transport device is disposed in the first developer containing portion 148. The agitating supply member 142 transports the developer 4 in a predetermined axial direction (for example, from right to left in FIG. 4). The agitating supply member 142, which is formed of synthetic resin by injection molding or the like, is a so-called screw auger. As illustrated in FIG. 5, the agitating supply member 142 has a rotation shaft 142*a* having a columnar shape or a cylindrical shape and a double-helix transport blade 142*b* integrally formed on an outer circumference of the rotation shaft 142*a*. The agitating supply member 142 is rotatable. The transport blade 142*b* is provided on the outer circumference of the rotation shaft 142*a* such that the two helices of the transport blade 142*b* are 180 degrees out of phase with each other. This may improve agitation and transportation characteristics for the developer 4. The agitating supply member 142 is a supply auger having the function of, in addition to the function of agitating the toner, supplying the developer 4 to the developing roller 141. A reverse transport blade 142*c* is provided in a short range along the axial direction at a downstream end portion in the transport direction of the agitating supply member 142. The reverse transport blade 142*c* transports in the opposite direction the developer 4 transported thereto by the agitating supply member 142 so as to move the developer 4 to the agitating transport member 143. Furthermore, the outer diameter of the rotation shaft 142*a* of the agitating supply member 142 is smaller at an upstream end portion 142*a*' in the transport direction than that at the other portion. As a result, a space is formed around the outer circumference of the upstream end portion 142*a*' of the rotation shaft 142*a* of the agitating supply member 142. This may improve passage characteristics for the developer 4 from the agitating transport member 143.

Figure 6A:
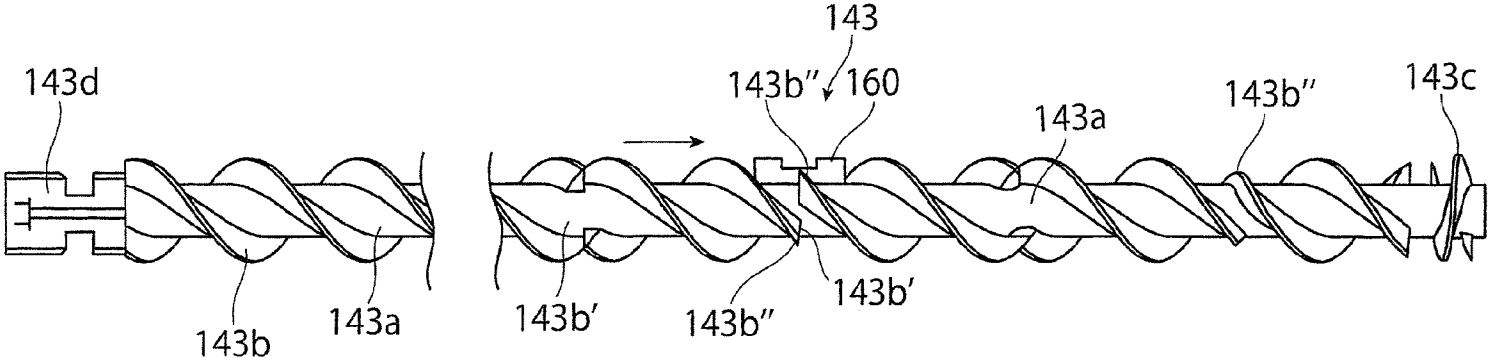
FIGS. 6A to 6C illustrate the structure of an agitating transport member.

Furthermore, as illustrated in FIG. 4, the helical agitating transport member 143 serving as an example of a second developer agitating transport device is disposed in the second developer containing portion 150. The agitating transport member 143 transports the developer 4 in a predetermined axial direction (for example, from left to right in FIG. 4). The agitating transport member 143, which is formed of synthetic resin by injection molding or the like, is a so-called screw auger. As illustrated in FIG. 6A, the agitating transport member 143 has a rotation shaft 143*a* having a columnar shape or a cylindrical shape and a double-helix transport blade 143*b* integrally formed on an outer circumference of the rotation shaft 143*a*. The agitating transport member 143 is rotatable. The transport blade 143*b* is provided on the outer circumference of the rotation shaft 143*a* such that the two helices of the transport blade 143*b* are 180 degrees out of phase with each other. This may improve the transportation characteristics of the developer 4. The pitch of turns of the transport blade 143*b* of the agitating transport member 143 is slightly larger than those of the transport blade 142*b* of the agitating supply member 142. The transport blade 143*b* has cuts 143*b*' formed by cutting parts of the transport blade 143*b* and diameter reduced portions 143*b*" where the outer diameter of the transport blade 143*b* is reduced compared to the other part. The cuts 143*b*' are also formed at the diameter reduced portions 143*b*" of the transport blade 143*b* of the agitating transport member 143. With the cuts 143*b*' and the diameter reduced portions 143*b*" provided in the transport blade 143*b*, in addition to a movement of the developer 4 in the axial direction, an intersecting movement of the developer 4 beyond the transport blade 143*b* in the circumferential direction is possible with the agitating transport member 143. This may increase the capability of agitating and mixing the developer 4. The agitating transport member 143 is an admix auger typically used for agitating and mixing the developer 4 contained in the second developer containing portion 150 with the toner with which the second developer containing portion 150 is replenished.

A reverse transport blade 143*c* is provided at a downstream end portion in the transport direction of the agitating transport member 143. The reverse transport blade 143*c* transports in the opposite direction the developer 4 transported thereto by the agitating transport member 143 so as to move the developer 4 to the agitating supply member 142. Furthermore, a scooping portion 143*d* having a cross shape in sectional view is formed at an upstream end portion in the transport direction of the agitating transport member 143. The scooping portion 143*d* scoops the developer 4 moved from the agitating supply member 142 positioned obliquely therebelow through the communication opening 151.

The first and second developer containing portions 148, 150 form a developer transport path in which the developer 4 is circulated through the communication openings 151, 152. The developer 4 contained in the first and second developer containing portions 148, 150 is circulated and transported through the developer transport path while being agitated and mixed by a pair of the helical agitating supply member 142 and the helical agitating transport member 143.

As illustrated in FIG. 4, a toner replenishment opening 153 is opened so as to be oriented obliquely upward near an upstream end portion of the second developer containing portion 150 in the transport direction of the developer 4. The second developer containing portion 150 is replenished with the toner supplied from the toner cartridge 145 through the toner replenishment opening 153. Furthermore, a toner density sensor 154 is disposed downstream of the center of the second developer containing portion 150 in the transport direction of the developer 4. The toner density sensor 154 serving as an example of a toner density detecting device detects the density of the toner in the developer 4. As illustrated in FIG. 3, the toner density sensor 154 is disposed so as to be in contact with an outer wall of the device housing 140 that forms the second developer containing portion 150. As the toner density sensor 154, for example, a device that detects the density of the toner in the developer 4 by utilizing variation of the magnetic permeability of the developer 4 due to variation of the toner density in the developer 4 is used. The toner density sensor 154 varies the frequency or the voltage of an output signal in accordance with the toner density in the developer 4. A device employing any method is able to be used as the toner density sensor 154 as long as the device is able to detect the density of the toner in the developer 4.

Figure 7:
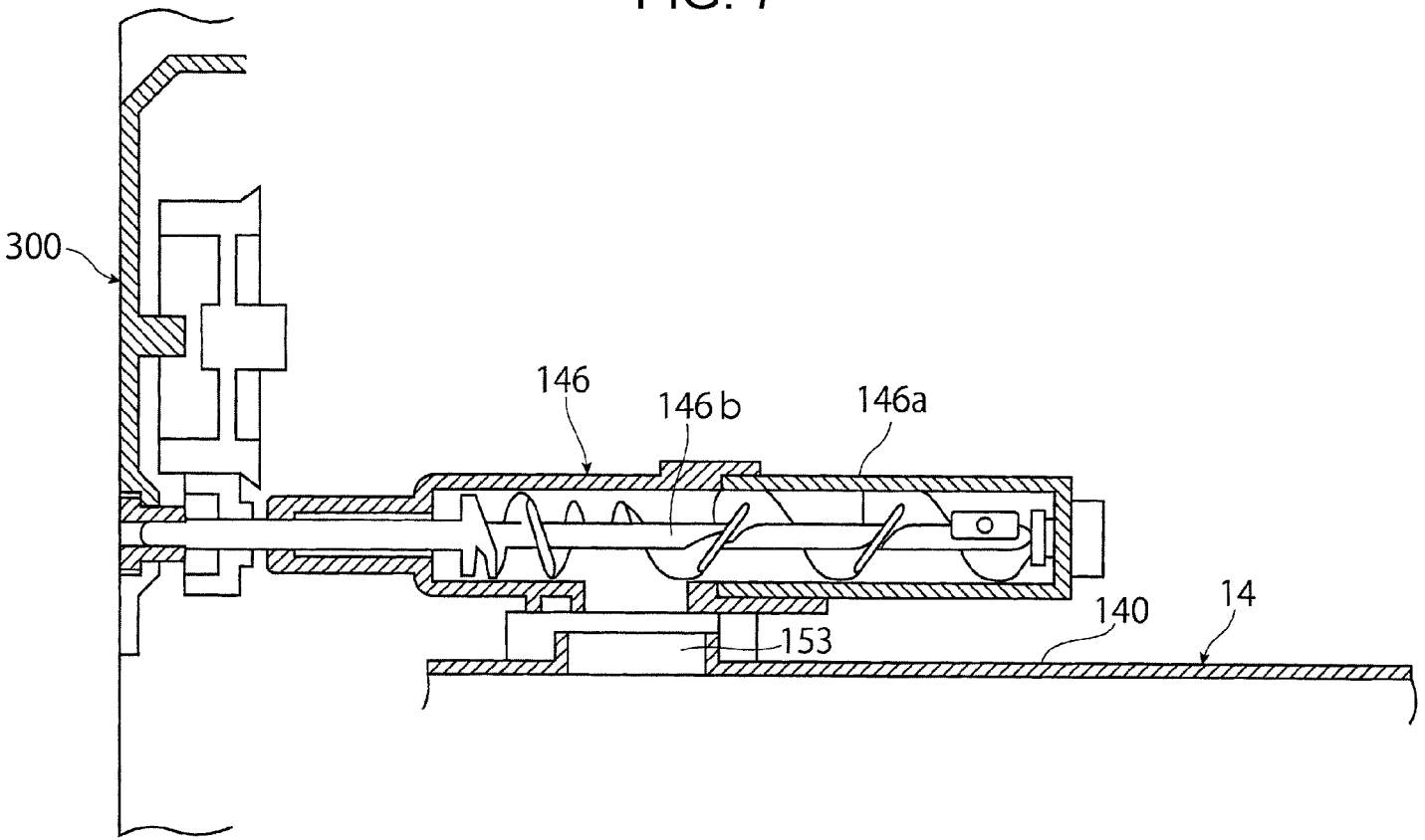
FIG. 7 is a sectional view of the structure of a toner supply device.

As illustrated in FIG. 7, the toner is supplied from the toner supply opening 145*a* of the toner cartridge 145 into the device housing 140 of the developing device 14 through the toner supply device 146. The toner supply device 146 includes a cylindrical supply device body 146*a*. Both ends of the supply device body 146*a* are closed. A transport member 146*b* having a helical transport blade is rotatably disposed in the supply device body 146*a*. The transport member 146*b* transports the toner supplied from the toner cartridge 145 to the toner replenishment opening 153 of the device housing 140 of the developing device 14.

Figure 6B:
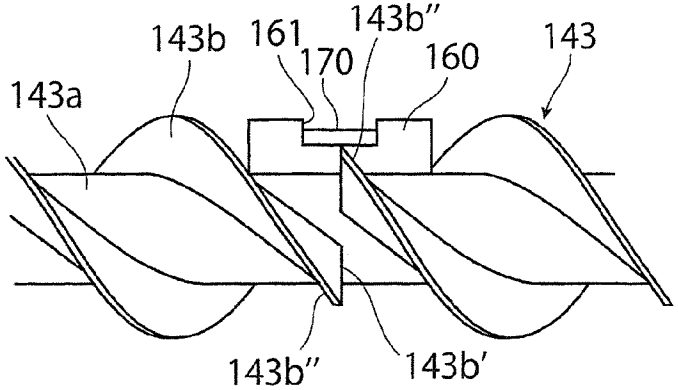
Figure 6C:
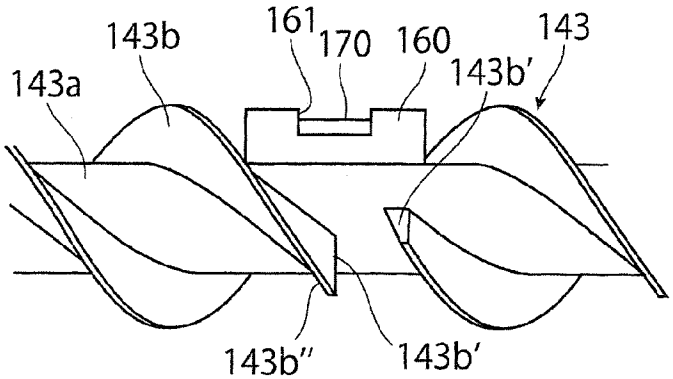

As illustrated in FIGS. 4, 6A and 6B, the agitating transport member 143 of the developing device 14 according to the first exemplary embodiment includes a paddle member 160 having a flat-plate shape at a position facing the toner density sensor 154. The paddle member 160 serving as an example of a retaining device causes the developer 4 to be temporarily retained by transporting the developer 4 in the circumferential direction of the agitating transport member 143. As illustrated in FIG. 6B, the paddle member 160 is disposed in the transport blade 143*b* of the agitating transport member 143 so as to correspond to the positions where the cuts 143*b*' and the diameter reduced portions 143*b*" are provided. According to the exemplary embodiment illustrated in, for example, FIG. 6B, the diameter reduced portion 143*b*" downstream of the other in the transport direction of the agitating transport member 143 extends to the paddle member 160. Alternatively, as illustrated in FIG. 6C, in the transport blade 143*b*, the cuts 143*b*' may be formed by cutting the diameter reduced portions 143*b*" at positions separated from the paddle member 160 in the transport blade 143*b*. Regarding an upstream side surface of the paddle member 160 in the rotating direction of the agitating transport member 143, the cuts 143*b*' may be formed by cutting the diameter reduced portions 143*b*" at positions separated from the paddle member 160.

Figure 8A:
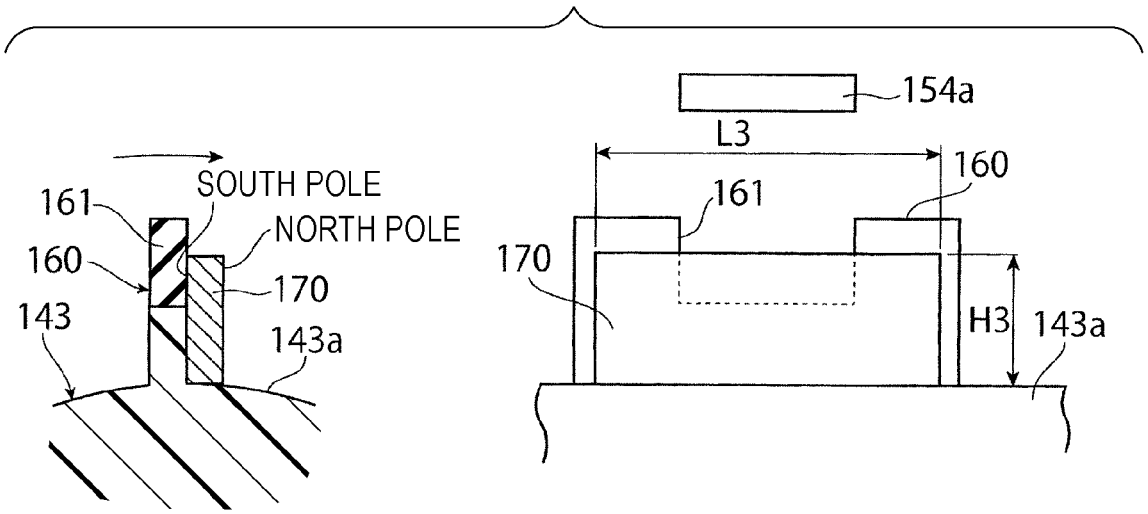
FIGS. 8A and 8B illustrate the structure of part of the agitating transport member.
Figure 8B:
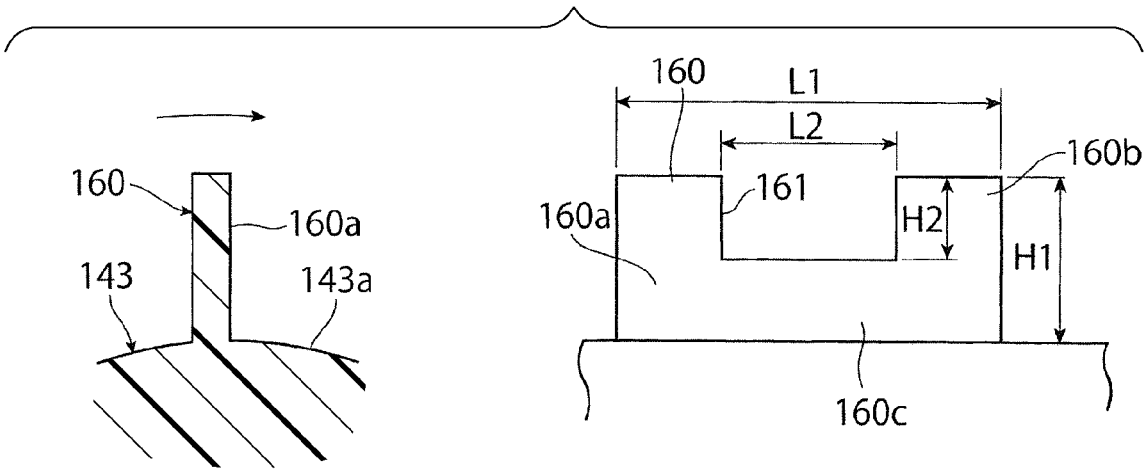

As illustrated in enlarged views of FIGS. 8A and 8B, the paddle member 160 is formed as a flat plate having a rectangular shape in plan view. The paddle member 160 is integrally formed on the outer circumference of the rotation shaft 143*a* of the agitating transport member 143 so as to extend radially outward. A projecting height H1 of the paddle member 160 is able to be set to be equal to the outer diameter of the helical transport blade 143*b* of the agitating transport member 143. However, the projecting height H1 of the paddle member 160 is not necessarily equal to the outer diameter of the transport blade 143*b* of the agitating transport member 143. As long as the projecting height H1 is such a height with which the paddle member 160 is not brought into contact with an inner circumferential surface of the developer transport path, the projecting height H1 may be larger than the outer diameter of the transport blade 143*b*, or, as opposed to this, the projecting height H1 may be smaller than the outer diameter of the transport blade 143*b*. A length L1 of the paddle member 160 in the axial direction of the agitating transport member 143 is set to be larger than the length of a detecting unit 154*a* of the toner density sensor 154.

The paddle member 160 has a recess 161 that is open toward an outer circumferential end of the paddle member 160 and formed by removing a portion of the paddle member 160 having a rectangular shape in front view. As a result, the paddle member 160 is divided into two perpendicular plate portions 160*a*, 160*b* and a lateral plate portion 160*c*. The perpendicular plate portions 160*a*, 160*b* are positioned at both the ends of the agitating transport member 143 in the axial direction. The lateral plate portion 160*c* integrally connects the perpendicular plate portions 160*a*, 160*b* to each other. The recess 161 is disposed at a central portion of the paddle member 160 in the axial direction of the agitating transport member 143. A height H2 of the recess 161 is able to be set to be, for example, about ½ of the projecting height H1 of the paddle member 160. Furthermore, a length L2 of the recess 161 in the axial direction of the agitating transport member 143 is able to be set to be about the same or longer than the length of the detecting unit 154*a* of the toner density sensor 154.

A permanent magnet (magnet) 170 that serves as an example of an attracting device and has a flat-plate shape in front view is held in a fixed state on a downstream side surface 160*a* in the rotating direction of the paddle member 160 by a method such as sticking with double-faced tape (not illustrated) or bonding with an adhesive (not illustrated). The permanent magnet 170 is a flat plate-shaped magnet in which one of the surfaces is magnetized to the south pole and the other surface is magnetized to the north pole. A height H3 of the permanent magnet 170 is able to be set such that, for example, the height H3 is smaller than the projecting height H1 of the paddle member 160 and the level of an upper end of the permanent magnet 170 is higher than the level of a lower end portion of the recess 161. The permanent magnet 170 is stuck with double-faced tape (not illustrated) or bonded to the surface of the paddle member 160 in a region other than the recess 161.

According to the present exemplary embodiment, with the recess 161 provided in the paddle member 160, the permanent magnet 170 is able to be held in the entire region of the paddle member 160 other than the recess 161. Thus, a holding surface for the permanent magnet 170 may be increased, and accordingly, forces with which the paddle member 160 and the permanent magnet 170 are fixed to each other may be increased. Furthermore, pressure applied from the developer 4 to the permanent magnet 170 acts on the paddle member 160. This may suppress separation of the permanent magnet 170 from the paddle member 160.

In the axial direction, a central position of the permanent magnet 170 is coincident with a central position of the recess 161 of the paddle member 160. Furthermore, in the axial direction, the central position of the permanent magnet 170 is coincident with a central position of the detecting unit 154*a* of the toner density sensor 154.

As illustrated in FIG. 8A, both the surfaces of an upper end portion of the permanent magnet 170 are exposed from the recess 161 of the paddle member 160 to the outside. In addition, the magnetic poles of both the polarities, that is, the south pole and the north pole, of the permanent magnet 170 are exposed to the developer transport path formed by the second developer containing portion 150 in the recess 161 of the paddle member 160. As a result, the developer 4 existing in the developer transport path is attracted along magnetic lines of force formed between the south pole and the north pole of the front and rear surfaces of the permanent magnet 170 so as to form a magnetic brush. The magnetic brush of the developer 4 attracted to the permanent magnet 170 projects outward in the radial direction of the paddle member 160. The degree of the outward projection of the magnetic brush of the developer 4 in the radial direction of the paddle member 160 is as follows: an outer circumferential end of the magnetic brush of the developer 4 may be brought into contact with the inner circumferential surface of the second developer containing portion 150 or is not necessarily brought into contact with the inner circumferential surface of the second developer containing portion 150.

Operation of the Developing Device

With the developing device 14 according to the present exemplary embodiment, by performing the following operation, accuracy in detecting the density of the developer 4 may be improved compared to the case where the magnetic pole of only one of the polarities of the attracting device that attracts the developer 4 by the magnetic force is exposed to the transport path facing the density detecting device.

In the developing device 14, as illustrated in FIG. 3, the toner in the developer 4 contained in the device housing 140 is gradually consumed by developing the electrostatic latent image formed on the surface of the photoconductor drum 11 with the developer 4 held on the surface of the developing roller 141. In the developing device 14, the density of the toner of the developer 4 in the device housing 140 is detected by the toner density sensor 154 mounted outside the second developer containing portion 150.

Based on a detection result of the toner density sensor 154, the controller 200 drives the toner supply device 146 at required timing so as to supply the toner from the toner cartridge 145 into the device housing 140 of the developing device 14 through the toner replenishment opening 153. The toner having been supplied into the device housing 140 is, as illustrated in FIG. 4, transported downstream in the axial direction by the agitating transport member 143 disposed in the second developer containing portion 150. In so doing, the toner having been supplied into the device housing 140 is agitated together with the developer 4 that has already existed in the second developer containing portion 150 and triboelectrically charged by being slid against the magnetic carrier in the developer 4.

The developer 4 transported downstream in the axial direction by the agitating transport member 143 reaches the position of the paddle member 160 disposed in a downstream portion in the transport direction. As illustrated in FIGS. 8A and 8B, the paddle member 160 is formed on the outer circumference of the rotation shaft 143*a* of the agitating transport member 143 so as to have a flat-plate shape extending outward in the radial direction. Accordingly, the developer having reached the position of the paddle member 160 is transported in the circumferential direction as the paddle member 160 is rotated. At the same time, the density of the toner in the developer 4 is detected by the toner density sensor 154 disposed at the position outside the device housing 140 corresponding to the paddle member 160.

Meanwhile, as illustrated in FIG. 8A, the permanent magnet 170 having a flat-plate shape is provided on the surface of the paddle member 160. Thus, the developer 4 existing near the paddle member 160 is attracted by the magnetic force of the permanent magnet 170.

Figure 9:
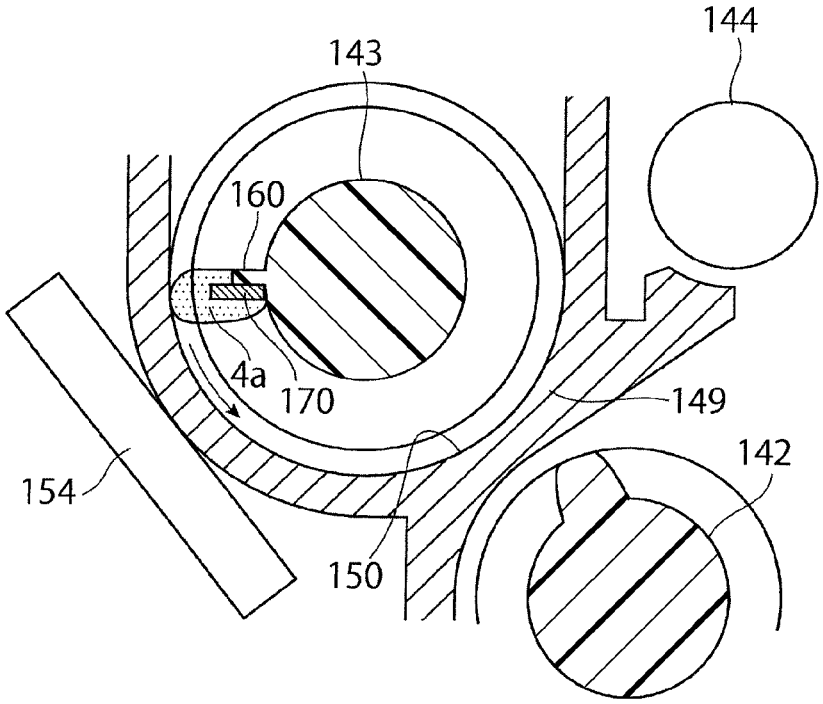
FIG. 9 is an enlarged sectional view of part of the developing device according to the first exemplary embodiment of the present disclosure.

In so doing, the paddle member 160 has the recess 161 formed at the distal end portion thereof, and the magnetic poles of both the polarities, that is, the south pole and the north pole at a distal end portion of the permanent magnet 170 are exposed to the developer transport path formed by the inner circumferential surface of the second developer containing portion 150 through the recess 161. As illustrated in FIG. 9, the developer 4 attracted to the permanent magnet 170 forms a magnetic brush 4*a* along the magnetic lines of force formed between the magnetic poles, that is, between the south pole and the north pole exposed on both the front and rear surfaces of the permanent magnet 170. The magnetic brush 4*a* of the developer 4 projects outward in the radial direction of the paddle member 160 in the developer transport path.

The developer 4 existing between the paddle member 160 and the inner circumferential surface of the second developer containing portion 150 is rubbed by the magnetic brush 4*a* of the developer 4 attracted to the permanent magnet 170 of the paddle member 160 rotated together with the agitating transport member 143, thereby the developer 4 existing between the paddle member 160 and the inner circumferential surface of the second developer containing portion 150 is moved in the circumferential direction. This replaces the developer 4 existing between the paddle member 160 and the inner circumferential surface of the second developer containing portion 150 with new developer 4.

Accordingly, the toner density sensor 154 detects the density of the developer 4 supplied to a region including a gap between the paddle member 160 and the inner circumferential surface of the second developer containing portion 150 naturally when the normal developing operation is performed and even when, for example, the replenishment operation with the toner is performed.

Experimental Example 1 and Comparative Examples 1 and 2

The developing device 14 as illustrated in FIG. 3 is prototyped, and an experiment in which the density of the toner is detected by the toner density sensor 154 while the density of the toner of the developer 4 in the device housing 140 is varied is performed under a laboratory environment performed at normal temperature and normal humidity. The rotation speed of the agitating transport member 143 is broadly set to be three types of speed as follows: a high speed Hi, a middle speed Mid, and a low speed Low. In addition, each of the three types of speeds is divided into a full speed for normal paper and a half speed for cardboards which are switchable to each other. The developing device 14 is operated at a highest rotation speed, that is, the full speed of the high speed Hi and at a lowest rotation speed, that is, a half speed of the low speed Low.

Experimental Example 1 is performed with the developing device 14 having the following structure is used: as illustrated in FIG. 8A, the permanent magnet 170 is provided in the paddle member 160 of the agitating transport member 143, and the recess 161 is formed in the paddle member 160 so as to allow the distal end portion of the permanent magnet 170 to be exposed to the developer transport path formed by the second developer containing portion 150.

Figure 10A:
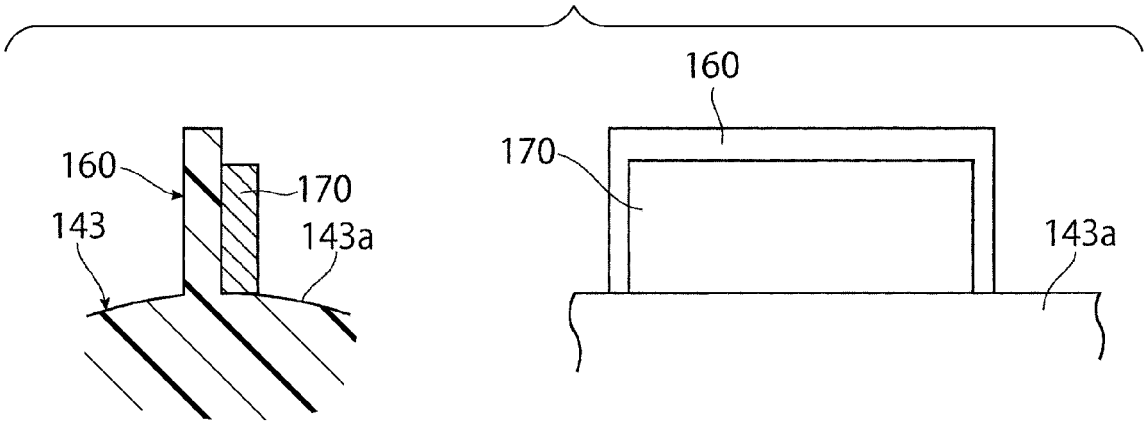
FIGS. 10A to 10C illustrate the structures of parts of developing devices according to Comparative Examples.

In Comparative Example 1, the developing device 14 having the following structure is used: as illustrated in FIG. 10A, although the permanent magnet 170 is provided in the paddle member 160 of the agitating transport member 143, the recess 161 is not formed in the paddle member 160, thereby the magnetic pole of only one of the polarities of the permanent magnet 170 is exposed to the developer transport path and the magnetic pole of the other polarity of the permanent magnet 170 is blocked by the paddle member 160.

Figure 10B:
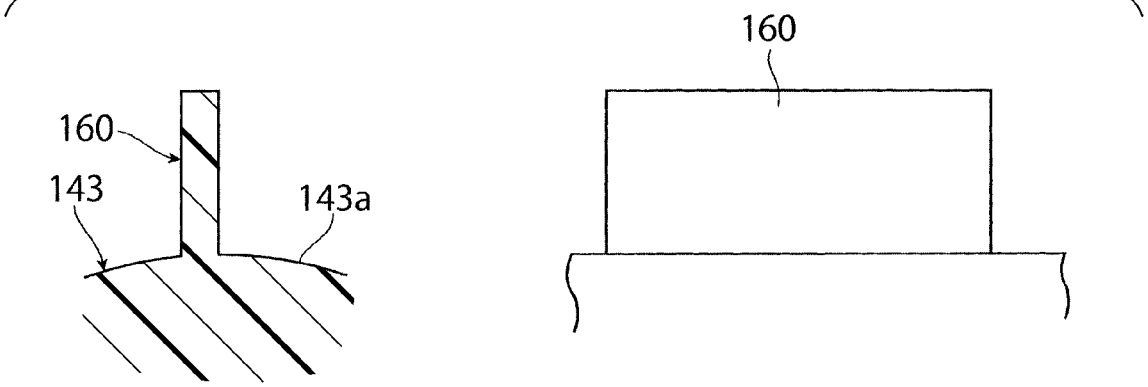

In Comparative Example 2, the developing device 14 having the following structure is used: as illustrated in FIG. 10B, the permanent magnet 170 is not provided in the paddle member 160 of the agitating transport member 143, and only the paddle member 160 is disposed.

Figure 11:
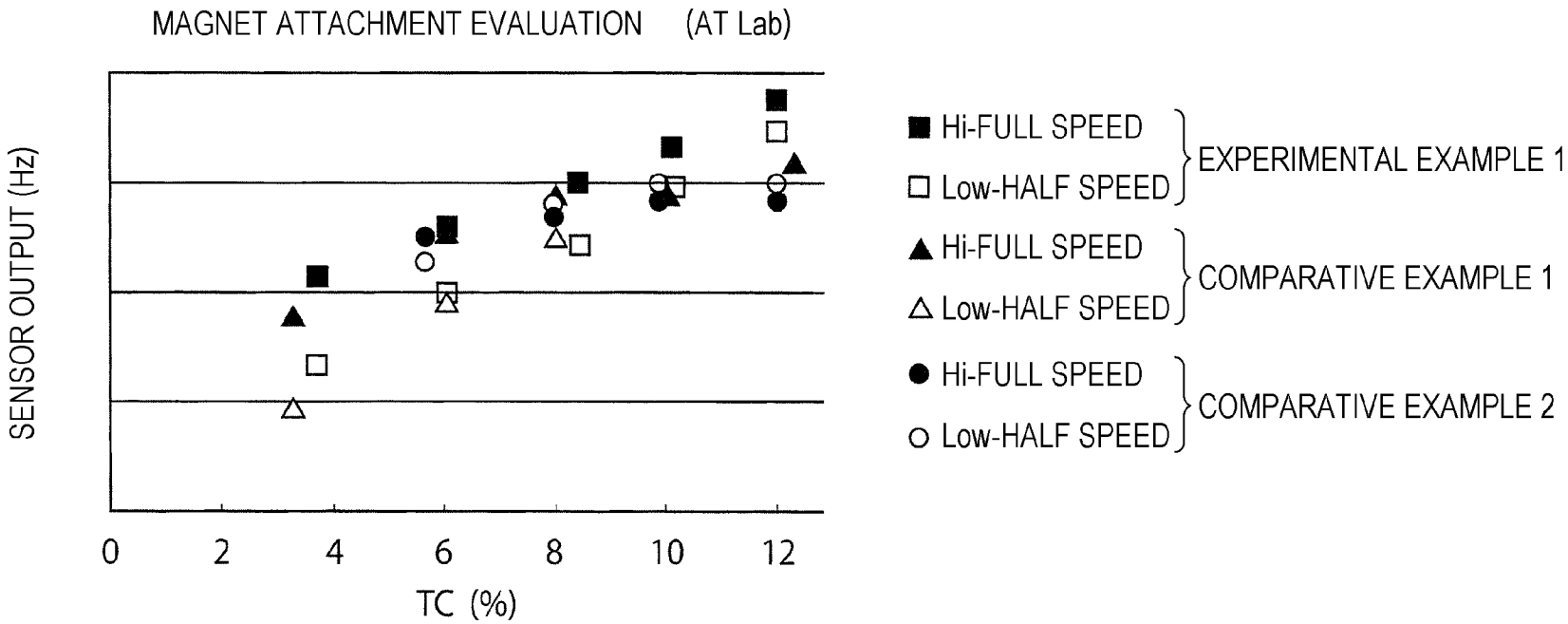
FIG. 11 is a graph illustrating results of Experimental Example 1 and Comparative Examples 1 and 2.

FIG. 11 is a graph illustrating results of Experimental Example 1 and Comparative Examples 1 and 2.

As clearly understood from FIG. 11, in the case of Experimental Example 1, the output of the toner density sensor 154 linearly increases as the density of the toner increases. Thus, it may be understood that the density of the toner is able to be accurately detected. The reason why there is a difference in output of the toner density sensor 154 between the operation where the rotation speed of the agitating transport member 143 is the full speed of Hi and the operation where the rotation speed of the agitating transport member 143 is the half speed of Low even when the density of the toner is the same is as follows: the amount of the developer 4 transported to a detecting region of the toner density sensor 154 per unit time varies in accordance with the rotation speed of the agitating transport member 143.

In the case of Comparative Example 1, in a region where the density of the toner is from about 3 to 8%, the output of the toner density sensor 154 substantially linearly increases as the density of the toner increases. However, when the density of the toner reaches 101 or higher, the gradient of the increase of the output of the toner density sensor 154 reduces. Thus, it may be understood that the density of the toner is not able to be accurately detected in a region where the density of the toner is high.

Figure 10C:
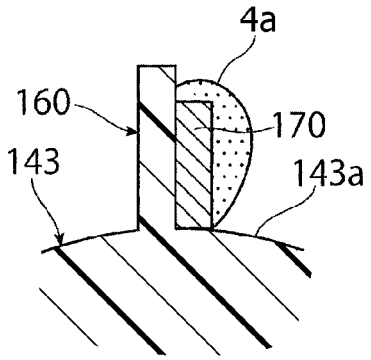
Figure 12:
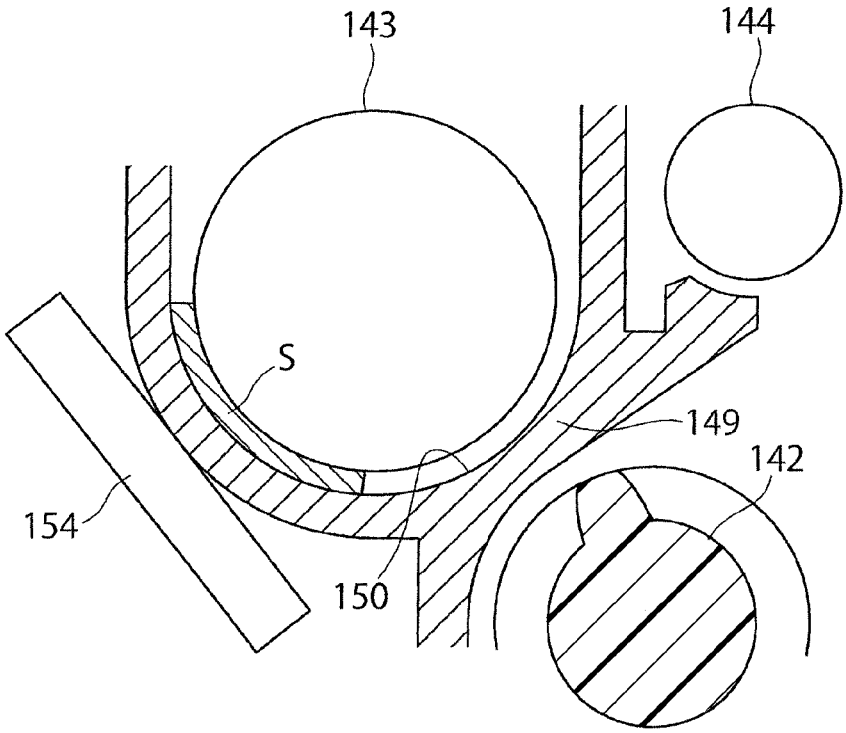
FIG. 12 is a sectional view of the structure of part of a related-art developing device.

The reason for this is that, as illustrated in FIG. 10C, although the permanent magnet 170 is provided in the paddle member 160 of the agitating transport member 143, the magnetic pole of only one of the magnetic polarities of the permanent magnet 170 is exposed to the developer transport path, and the magnetic brush 4*a* of the developer 4 attracted to the permanent magnet 170 does not exist beyond the outer circumferential end of the paddle member 160. Accordingly, as illustrated in FIG. 12, a so-called dead space S where the developer 4 is retained and rarely moved exists between the outer circumference of the agitating transport member 143 and the inner circumferential surface of the developer transport path formed by the second developer containing portion 150. Accordingly, the reason is thought to be that, even when the density of the toner in the developer 4 varies, the density of the toner is not necessarily able to be accurately detected due to influence of the developer 4 existing in the dead space S.

In the case of Comparative Example 2, in a region where the density of the toner is from about 6 to 8%, the output of the toner density sensor 154 increases as the density of the toner increases. However, when the density of the toner reaches 10% or higher, the output of the toner density sensor 154 varies little. Thus, it may be understood that the density of the toner is not able to be accurately detected. The reason for this is that, as described above, when only the paddle member 160 is provided in the agitating transport member 143, formation of the dead space S of the developer 4 existing between the outer circumference of the agitating transport member 143 and the inner circumferential surface of the developer transport path formed by the second developer containing portion 150 is not necessarily able to be suppressed.

Experimental Example 2

Next, the developing device 14 as illustrated in FIG. 3 is prototyped, and an experiment in which the density of the developer 4 in the device housing 140 is detected by the toner density sensor 154 is performed. In Experimental Example 2, in order to observe influence of environmental disturbance, an experiment is performed in which the density of the toner is detected while the developing device 14 is being operated under the laboratory environment performed at normal temperature and normal humidity and a high-temperature high-humidity environment.

Figure 13:
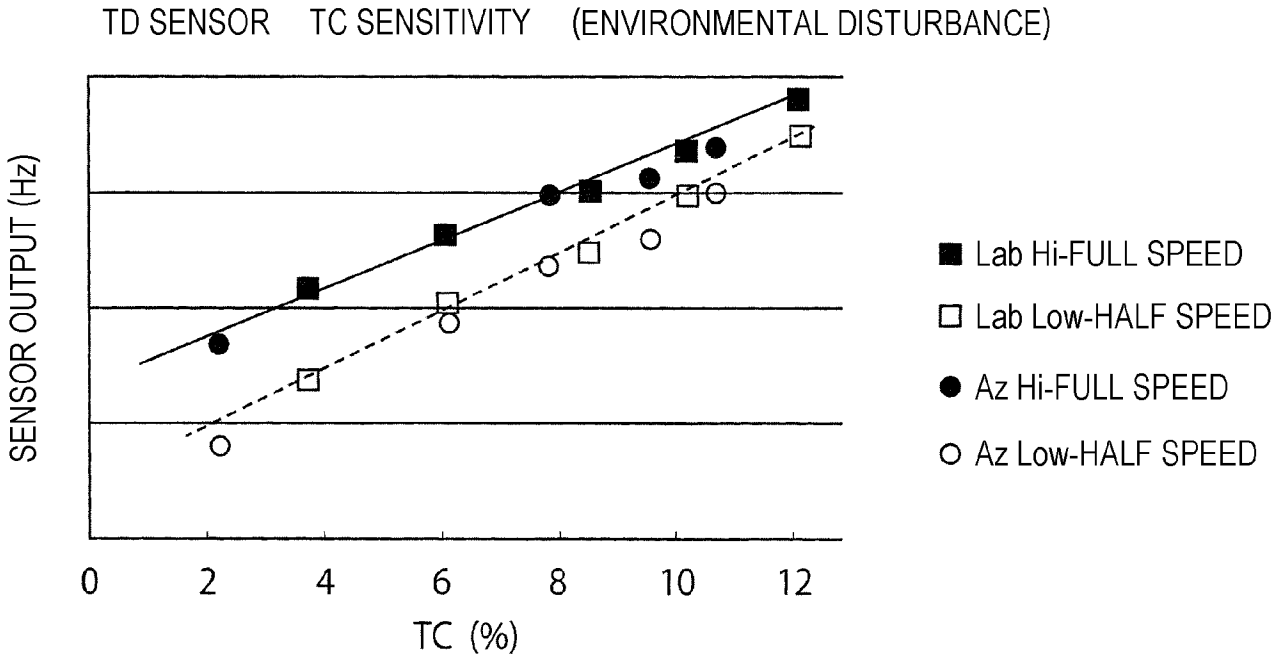
FIG. 13 is a graph illustrating results of Experimental Example 2.

FIG. 13 is a graph illustrating results of Experimental Example 2.

As clearly understood from FIG. 13, in the case of Experimental Example 2, under both a laboratory environment Lab performed at normal temperature and normal humidity and a high-temperature high-humidity environment Az, the output of the toner density sensor 154 substantially linearly increases as the density of the toner increases. Thus, it may be understood that the density of the toner is able to be accurately detected regardless of variation of the environmental.

Experimental Example 3

Next, the developing device 14 as illustrated in FIG. 3 is prototyped, and an experiment in which the density of the developer 4 in the device housing 140 is detected by the toner density sensor 154 is performed. Experimental Example 3 checks how the output of the toner density sensor 154 varies when the shape of the permanent magnet 170 and the position where the permanent magnet 170 is mounted are deviated from the design within tolerable ranges.

Specifically, in Experimental Example 3-1, the shape of the permanent magnet 170 is a central value of the tolerable range and the mounting position of the permanent magnet 170 is a central position of the tolerable range, and in Experimental Example 3-2, the shape of the permanent magnet 170 is a lower limit value of the tolerable range and the mounting position of the permanent magnet 170 is a lower limit position of a target range.

Figure 14:
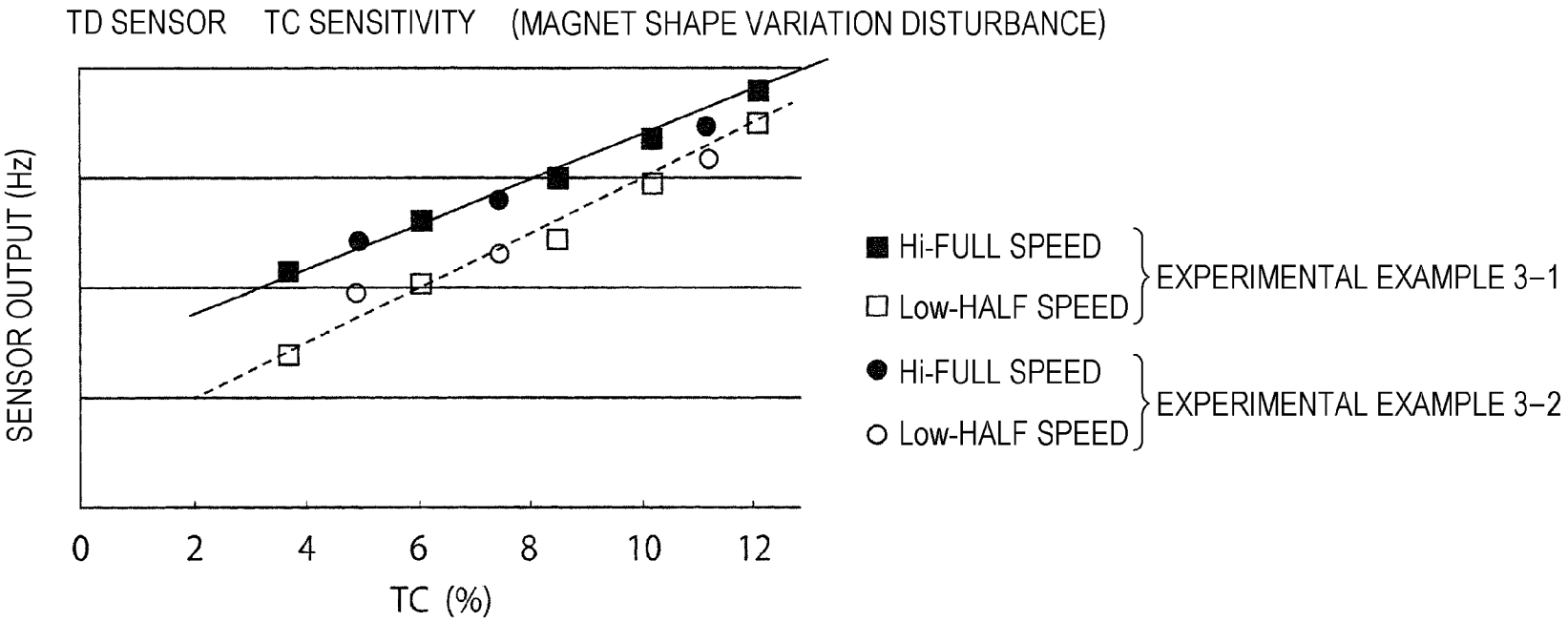
FIG. 14 is a graph illustrating results of Experimental Example 3.

FIG. 14 is a graph illustrating results of Experimental Example 3.

As clearly understood from FIG. 14, in Experimental Example 3, the output of the toner density sensor 154 substantially linearly increases as the density of the toner increases naturally in the case where the shape of the permanent magnet 170 is the central value of the tolerable range and the mounting position of the permanent magnet 170 is the central position of the tolerable range and even in the case where the shape of the permanent magnet 170 is the lower limit value of the tolerable range and the mounting position of the permanent magnet 170 is the lower limit position of the target range similarly to the former case. Thus, it may be understood that the density of the toner is able to be accurately detected regardless of variation of the mounting position and the shape of the permanent magnet 170.

As has been described, with the developing device 14 according to the first exemplary embodiment, accuracy in detecting the density of the developer 4 with the toner density sensor 154 may be improved compared to the case where the magnetic pole of only one of the polarities of the attracting device that attracts the developer 4 by the magnetic force is exposed to the transport path facing the density detecting device.

Furthermore, according to the first exemplary embodiment, in the axial direction of the agitating transport member 143, a length L3 of the permanent magnet 170 is set to be smaller than the length L1 of the paddle member 160. When the length L3 of the permanent magnet 170 is the same as the length L1 of the paddle member 160 in the axial direction of the agitating transport member 143, the amount of the developer 4 in excess of the amount of the developer 4 required to be scraped off from the dead space S is also attracted to both end portions of the permanent magnet 170 in the axial direction of the agitating transport member 143. This may increase the amount of the retained developer 4, and accordingly, lead to false detection. Accordingly, in the axial direction of the agitating transport member 143, the length L3 of the permanent magnet 170 is set to be smaller than the length L1 of the paddle member 160. This may suppress the occurrences of false detection due to attraction of the developer 4 to both the end portions of the permanent magnet 170 in the axial direction of the agitating transport member 143.

Variation

Figure 15:
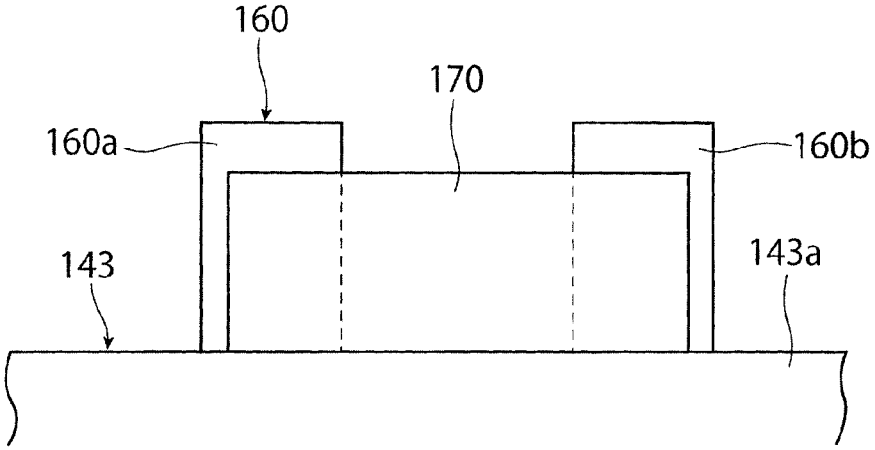
FIG. 15 illustrates the structure of part of a variation of the developing device according to the first exemplary embodiment of the present disclosure.

FIG. 15 illustrates the structure of a variation of the developing device according to the first exemplary embodiment of the present disclosure.

According to this variation, as illustrated in FIG. 15, the recess provided in the paddle member 160 extends to the surface of the rotation shaft 143*a* of the agitating transport member 143. As a result, the paddle member 160 is separated into two perpendicular plate portions 160*a*, 160*b* arranged in the axial direction of the agitating transport member 143. The permanent magnet 170 is held in a state in which the permanent magnet 170 is fixed to the two perpendicular plate portions 160*a*, 160*b* of the paddle member 160 with double-faced tape or the like.

According to this variation, the permanent magnet 170 is entirely exposed to the developer transport path. Thus, compared to the first exemplary embodiment, the magnetic brush 4*a* of the developer 4 may be appropriately formed. Accordingly, the dead space S of the developer 4, which exists between the outer circumference of the agitating transport member 143 and the inner circumferential surface of the developer transport path formed by the second developer containing portion 150, may be more reliably reduced.

Second Exemplary Embodiment

Figure 16A:
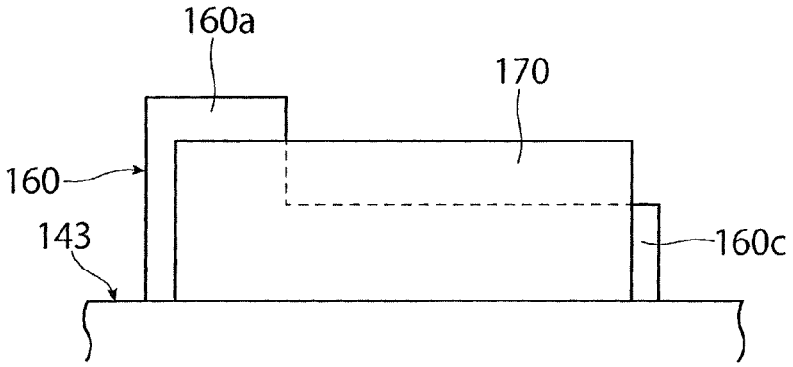
FIGS. 16A and 16B illustrate the structure of part of the developing device according to a second exemplary embodiment of the present disclosure.
Figure 16B:
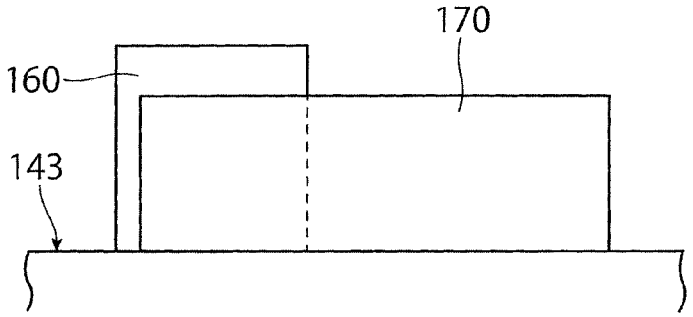

FIGS. 16A and 16B illustrate the structure of part of the developing device according to a second exemplary embodiment. According to the second exemplary embodiment, the retaining device has a projection that projects further outward in the radial direction of the agitating transport device than the attracting device, and, in the axial direction of the agitating transport device, the length of the projection is set to be smaller than the length of the attracting device.

That is, in the developing device 14 according to the second exemplary embodiment, as illustrated in FIGS. 16A and 16B, instead of providing the recess 161 in the paddle member 160, a substantially L shape in front view is formed by the perpendicular plate portion 160*a* and the lateral plate portion 160*c*. The perpendicular plate portion 160*a* is an outward projecting portion of the paddle member 160 in the radial direction and serves as an example of the projection. The lateral plate portion 160*c* is provided in a direction intersecting the perpendicular plate portion 160*a* and has a smaller height than the perpendicular plate portion 160*a*. In this case, an upper portion of the permanent magnet 170 projects from the lateral plate portion 160*c* of the paddle member 160.

The permanent magnet 170 is fixed to the perpendicular plate portion 160*a* and the lateral plate portion 160*c* of the paddle member 160 with double-faced tape or the like. In the axial direction of the agitating transport member 143, the length of the perpendicular plate portion 160*a* is set to be smaller than the length of the permanent magnet 170.

According to the second exemplary embodiment, a projecting region being a projecting portion of the permanent magnet 170 from the paddle member 160 may be increased in the axial direction of the agitating transport member 143. Accordingly, the magnetic brush 4*a* of the developer 4 may be formed along an extended region in the axial direction of the agitating transport member 143.

As illustrated in FIG. 16B, the lateral plate portion 160*c* may be omitted from the paddle member 160 and the paddle member 160 may have only the perpendicular plate portion 160*a*.

Third Exemplary Embodiment

Figure 17A:
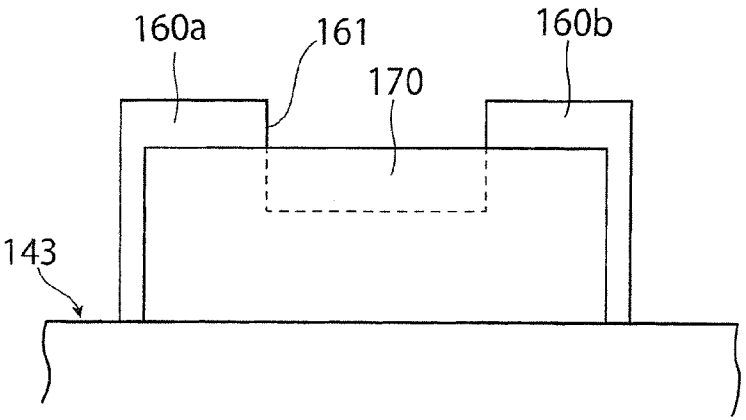
FIGS. 17A to 17C illustrate the structure of part of the developing device according to a third exemplary embodiment of the present disclosure.
Figure 17B:
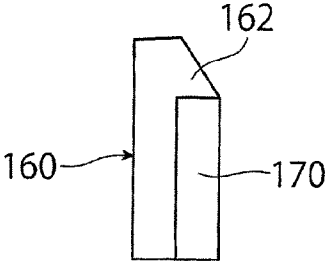
Figure 17C:
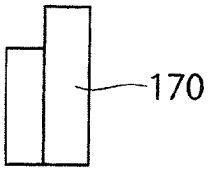

FIGS. 17A to 17C illustrate the structure of the developing device according to a third exemplary embodiment. According to the third exemplary embodiment, the attracting device is secured by securing pieces provided in the retaining device such that the securing pieces are elastically deformable.

In the developing device according to the third exemplary embodiment, in front view, the paddle member 160 has a shape having the recess 161 at the distal end portion thereof similarly to the shape of the paddle member 160 according to the first exemplary embodiment. However, instead of being fixed to the surface of the paddle member 160 with the double-faced tape or the like, the permanent magnet 170 is secured by securing pieces 162 provided at the distal end of the paddle member 160 such that the securing pieces 162 are elastically deformable.

As illustrated in FIG. 17B, the securing pieces 162 are respectively integrally provided on the perpendicular plate portions 160*a*, 160*b* positioned at both the end portions of the paddle member 160. The securing pieces 162 project in a direction toward the permanent magnet 170 so as to have a nail shape having a triangular shape in sectional view. In the paddle member 160, the perpendicular plate portions 160*a*, 160*b* are elastically deformed so as to secure the upper end of the permanent magnet 170 with the securing pieces 162. Thus, the permanent magnet 170 is held in the fixed state.

According to the third exemplary embodiment, the double-faced tape is not required. This may facilitate fixing of the permanent magnet 170.

Fourth Exemplary Embodiment

Figure 18:
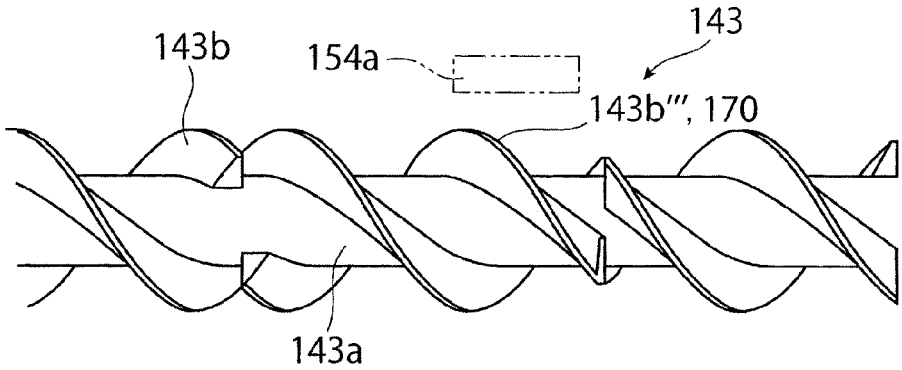
FIG. 18 is a perspective view of the structure of part of the developing device according to a fourth exemplary embodiment of the present disclosure.

FIG. 18 illustrates the structure of the developing device according to a fourth exemplary embodiment. According to the fourth exemplary embodiment, the attracting device is included in the transport blade itself of the agitating transport device.

That is, in the agitating transport member 143 of the developing device according to the fourth exemplary embodiment, as illustrated in FIG. 18, a transport blade 143*b*''' disposed at a position corresponding to the detecting unit 154*a* of the toner density sensor 154 is formed of a magnetic material. The front and rear surfaces of the transport blade 143*b*''' formed of the magnetic material are respectively magnetized to the south pole and the north pole, thereby the permanent magnet 170 is configured. The transport blade 143*b*''' is provided such that the transport blade 143*b*''' is fixed to the rotation shaft 143*a* of the agitating transport member 143 by a method such as bonding.

According to the fourth exemplary embodiment, the transport blade 143*b*''' being part of the transport blade 143*b* of the agitating transport member 143 includes the permanent magnet 170. Thus, the developer 4 transported by the agitating transport member 143 is attracted by the magnetic force of the permanent magnet 170 included in the transport blade 143*b*''' being part of the transport blade 143*b*, thereby forming a magnetic brush.

According to the fourth exemplary embodiment, the permanent magnet 170 may be easily provided and the paddle member 160 is not necessarily provided.

Fifth Exemplary Embodiment

FIGS. 19A to 19D illustrate the structure of the developing device according to a fifth exemplary embodiment. According to the fifth exemplary embodiment, front and rear surfaces of the retaining device are interposed between portions of the attracting device.

That is, as illustrated in FIGS. 19A to 19D, the paddle member 160 of the developing device 14 according to the fifth exemplary embodiment has a flat-plate shape having a smaller height than that of the paddle member 160 according to the first exemplary embodiment. The permanent magnet 170 is mounted on the paddle member 160 such that the paddle member 160 is interposed between the portions of the permanent magnet 170. The permanent magnet 170 has a flat-plate shape having a larger thickness than that of the paddle member 160. The permanent magnet 170 has a groove 171 at the lower end surface thereof. The groove 171 allows the paddle member 160 to be fitted thereinto. The permanent magnet 170 is fixed to the agitating transport member 143 by fitting the paddle member 160 into the groove 171. Of course, in fixing the permanent magnet 170, an adhesive or the like may be used according to need.

According to the fifth exemplary embodiment, the magnetic poles of both the polarities of the permanent magnet 170 may be reliably exposed to the transport path.

Figure 19A:
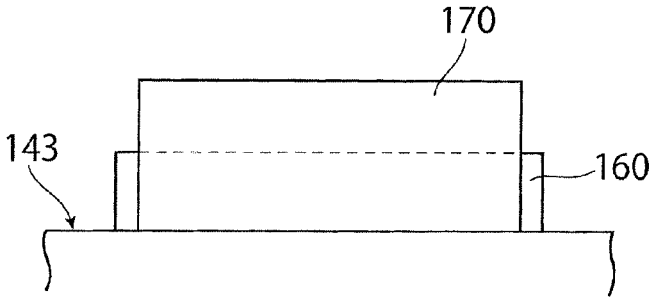
FIGS. 19A to 19D illustrate the structure of part of the developing device according to a fifth exemplary embodiment of the present disclosure.
Figure 19B:
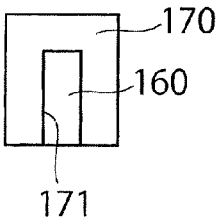
Figure 19C:
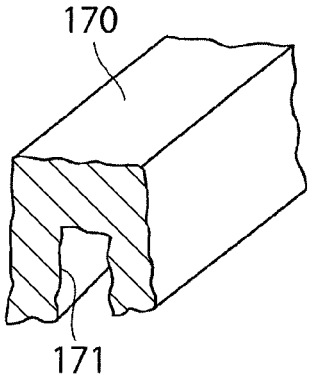
Figure 19D:
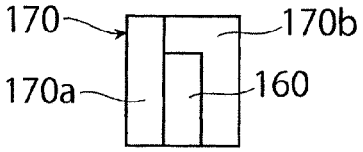

The permanent magnet 170 is not necessarily a single member. As illustrated in FIG. 19D, the permanent magnet 170 may be separated into two members, that is, a first member 170*a* having a flat-plate shape in sectional view and a second member 170*b* having a substantially L-shape in sectional view.

Sixth Exemplary Embodiment

Figure 20A:
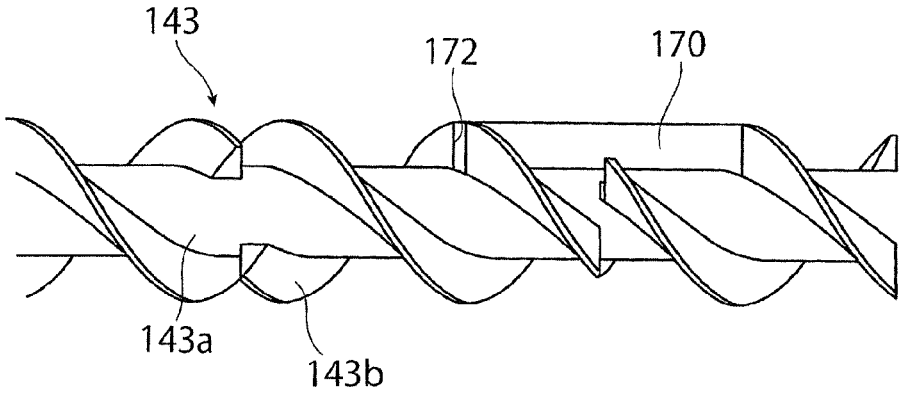
FIGS. 20A and 20B are perspective views of the structure of part of the developing device according to a sixth exemplary embodiment of the present disclosure.
Figure 20B:
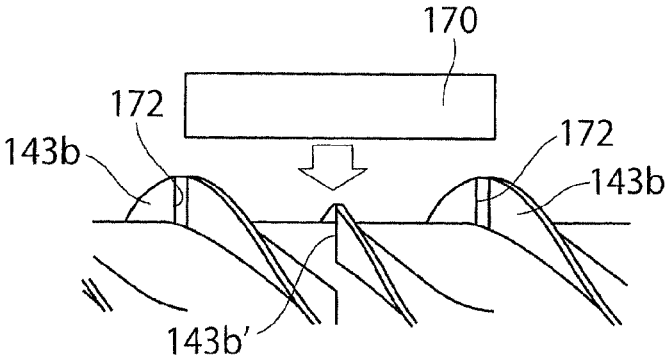

FIGS. 20A and 20B illustrate the structure of the developing device according to a sixth exemplary embodiment. According to the sixth exemplary embodiment, the attracting device is inserted into cuts provided in a plurality of turns of the transport blade in the axial direction of the agitating transport device.

That is, as illustrated in FIGS. 20A and 20B, in the developing device according to the sixth exemplary embodiment, cuts 172 are provided so as to allow the flat plate-shaped permanent magnet 170 to be fitted into the transport blade 143*b* of the agitating transport member 143. The cuts 172 are formed in adjacent turns of the same helix of the transport blade 143*b* out of the two helices of the transport blade 143*b* formed on the outer circumference of the rotation shaft 143*a* of the agitating transport member 143. Furthermore, a cut 143*b*' is provided in one of the turns of the other helix of the transport blade 143*b* positioned between the adjacent turns of the same helix of the transport blade 143*b*. The permanent magnet 170 is inserted through the cuts 143*b*'.

The permanent magnet 170 is fitted into the cuts 172 formed in the adjacent turns of the same helix of the transport blade 143*b* so as to be fixed.

According to the sixth exemplary embodiment, the permanent magnet 170 is also able to function as the retaining device.

Seventh Exemplary Embodiment

Figure 21A:
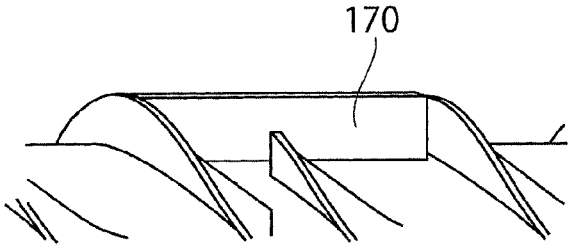
FIGS. 21A to 21C are perspective views of the structure of part of the developing device according to a seventh exemplary embodiment of the present disclosure.
Figure 21B:
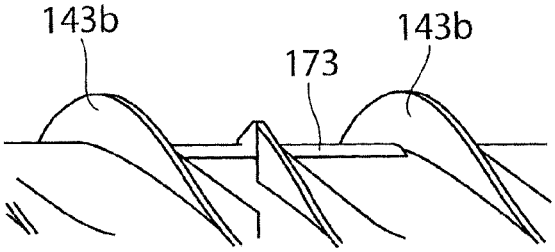
Figure 21C:
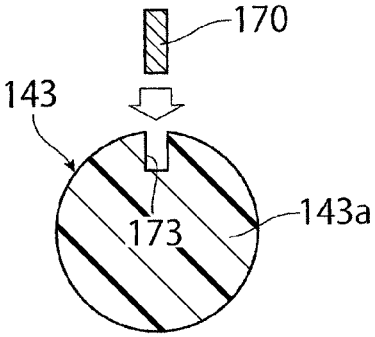

FIGS. 21A to 21C illustrate the structure of the developing device according to a seventh exemplary embodiment. According to the seventh exemplary embodiment, the attracting device is inserted into a groove provided in a shaft portion the agitating transport device.

That is, as illustrated in FIGS. 21A to 21C, in the developing device 14 according to the seventh exemplary embodiment, a groove 173 is formed in the axial direction of the rotation shaft 143*a* of the agitating transport member 143. The flat plate-shaped permanent magnet 170 is fitted into the groove 173 so as to be fixed.

According to the seventh exemplary embodiment, the permanent magnet 170 is able to be provided independently of the pitch of the turns of the transport blade 143*b* of the agitating transport member 143.

Eighth Exemplary Embodiment

Figure 22A:
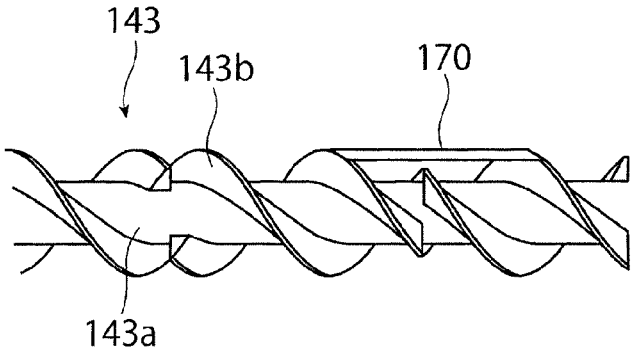
FIGS. 22A to 22C are perspective views of the structure of part of the developing device according to an eighth exemplary embodiment of the present disclosure.
Figure 22B:
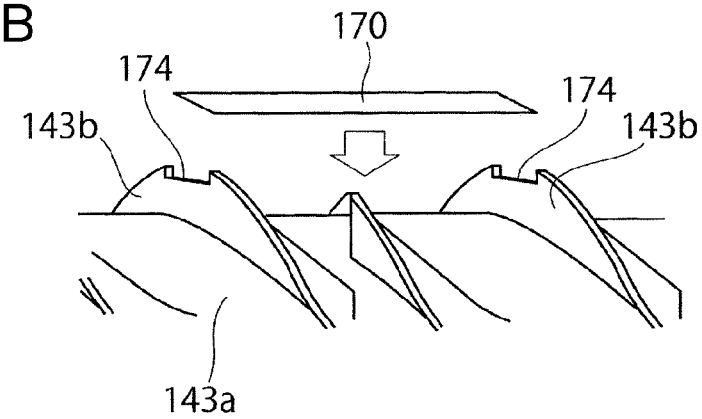
Figure 22C:
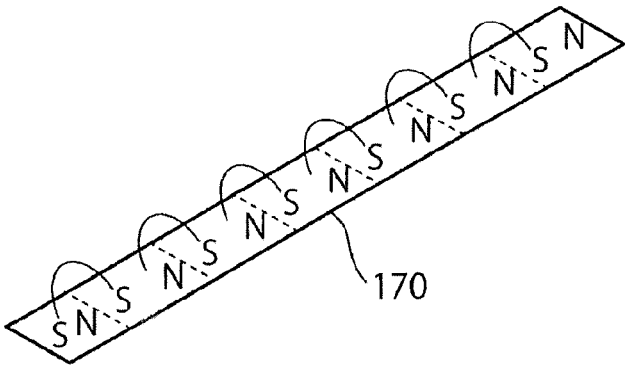

FIGS. 22A to 22C illustrate the structure of the developing device according to an eighth exemplary embodiment. According to the eighth exemplary embodiment, the attracting device is disposed so as to extend over a plurality of the turns of the transport blade in the axial direction of the agitating transport device.

That is, as illustrated in FIGS. 22A to 22C, in the developing device 14 according to the eighth exemplary embodiment, cuts 174 are formed so as to allow the elongated flat plate-shaped permanent magnet 170 to be mounted on an outer circumferential end of the transport blade 143*b* of the agitating transport member 143. The cuts 174 are formed in the circumferential direction in the outer circumferential ends of adjacent turns of the same helix of the transport blade 143*b* out of the two helices of the transport blade 143*b* formed on the outer circumference of the rotation shaft 143*a* of the agitating transport member 143.

The permanent magnet 170 is fitted into the cuts 174 of the transport blade 143*b* at both the ends thereof so as to be fixed. In so doing, the permanent magnet 170 is fixed to the cuts 174 of the transport blade 143*b* with an adhesive according to need.

As illustrated in FIG. 22C, the permanent magnet 170 is magnetized alternately to the south pole and to the north pole in the longitudinal direction on the surface thereof on the outer circumferential side. Thus, magnetic lines of force are formed between the adjacent north and south poles.

In the developing device 14 according to the eighth exemplary embodiment, the permanent magnet 170 is disposed so as to extend over the adjacent turns of the same helix of the transport blade 143*b*. Accordingly, influence of the permanent magnet 170 on the transportation characteristics for the developer 4 may be reduced, and the magnetic brush 4*a* of the developer 4 may be reliably formed.

According to the above-described exemplary embodiments, the developing device is of a monochrome image forming apparatus including the image making device 10 only for black K. However, of course, the techniques described herein are similarly applicable to developing devices of a full-color image forming apparatus including image making devices 10Y, 10M, 10C, 10K for yellow Y, magenta M, cyan C, and black K.

According to the above-described exemplary embodiments, the permanent magnet is used as the attracting device. However, the attracting device is not limited to the permanent magnet. Although it is required to supply power through the agitating transport member, an electromagnet may be used as the attracting device.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A developing device comprising:

an agitating transport device that has a transport path and that transports developer including a magnetic carrier while agitating the developer;

a density detecting device that detects density of the developer in the transport path of the agitating transport device; and an attracting device that is disposed on the agitating transport device and that has magnetic poles of one and another polarities exposed to the transport path facing the density detecting device so as to attract the developer by a magnetic force, wherein the agitating transport device includes a flat plate-shaped retaining device that transports to a position facing the density detecting device the developer in a circumferential direction of the agitating transport device so as to cause the developer to be retained, and wherein the attracting device is held by the retaining device.

2. The developing device according to claim 1, wherein the attracting device has, in an axial direction of the agitating transport device, one and another end portions positioned inside the retaining device.

3. The developing device according to claim 1, wherein the retaining device has a central portion in an axial direction of the agitating transport device and a recess formed at the central portion, and wherein the magnetic poles of the one and the other polarities of the attracting device are exposed to the transport path in the recess of the retaining device.

4. The developing device according to claim 3, wherein the retaining device is disposed such that, in the axial direction of the agitating transport device, a center of the density detecting device is positioned in the recess of the agitating transport device.

5. The developing device according to claim 4, wherein the retaining device is disposed such that, in the axial direction of the agitating transport device, the center of the density detecting device is coincident with a center of the recess.

6. The developing device according to claim 1, wherein the retaining device has an elastically deformable securing piece, and wherein the attracting device is secured by the securing piece.

7. A developing device comprising:

an agitating transport device that has a transport path and that transports developer including a magnetic carrier while agitating the developer;

a density detecting device that detects density of the developer in the transport path of the agitating transport device; and an attracting device that is disposed on the agitating transport device and that has magnetic poles of one and another polarities exposed to the transport path facing the density detecting device so as to attract the developer by a magnetic force, wherein the agitating transport device includes a retaining device that has a projection at part of the retaining device, wherein, in a radial direction of the agitating transport device, the projection projects further outward than the attracting device, and wherein the attracting device is held by the projection of the retaining device.

8. The developing device according to claim 7, wherein, in an axial direction of the agitating transport device, a length of the projection is smaller than a length of the attracting device.

9. A developing device comprising:

means for agitating and transporting that has a transport path and that transports developer including a magnetic carrier while agitating the developer;

means for detecting density that detects density of the developer in the transport path of the means for agitating and transporting; and means for attracting that is provided in the means for agitating and transporting and that has magnetic poles of one and another polarities exposed to the transport path facing the means for detecting density so as to attract the developer by a magnetic force.

* * * * *